US012385341B2

(12) United States Patent
Sonat et al.

(10) Patent No.: US 12,385,341 B2
(45) Date of Patent: Aug. 12, 2025

(54) DELAYED ACCELERATION OF EXPANDABLE METAL REACTION WITH GALVANIC CORROSION

(71) Applicant: Halliburton Energy Services, Inc., Houston, TX (US)

(72) Inventors: Cem Sonat, Singapore (SG); Mathusan Mahendran, Singapore (SG); Chris M. Pelto, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/458,357

(22) Filed: Aug. 30, 2023

(65) Prior Publication Data

US 2025/0075574 A1 Mar. 6, 2025

(51) Int. Cl.
*E21B 23/01* (2006.01)
*E21B 43/10* (2006.01)

(52) U.S. Cl.
CPC ..... *E21B 23/01* (2013.01); *E21B 43/108* (2013.01)

(58) Field of Classification Search
CPC ..... E21B 23/01; E21B 43/08; E21B 43/108; E21B 43/105; E21B 43/103
See application file for complete search history.

(56) References Cited

U.S. PATENT DOCUMENTS

| | | | | |
|---|---|---|---|---|
| 2016/0230494 | A1* | 8/2016 | Fripp | C22C 23/04 |
| 2020/0347694 | A1* | 11/2020 | Power | E21B 33/1293 |
| 2021/0123320 | A1* | 4/2021 | Norman | E21B 34/14 |
| 2021/0131210 | A1* | 5/2021 | Greci | E21B 23/06 |
| 2022/0178222 | A1 | 6/2022 | Fripp et al. | |
| 2023/0203916 | A1 | 6/2023 | Sherman | |
| 2023/0228183 | A1 | 7/2023 | Fripp et al. | |

FOREIGN PATENT DOCUMENTS

| | | |
|---|---|---|
| CN | 109133773 | 7/2021 |
| WO | 2019094044 A1 | 5/2019 |
| WO | 2019164499 A1 | 8/2019 |
| WO | 2022250705 | 12/2022 |

* cited by examiner

*Primary Examiner* — Nicole Coy
*Assistant Examiner* — Jennifer A Railey
(74) *Attorney, Agent, or Firm* — Scott Richardson; Parker Justiss, P.C.

(57) ABSTRACT

Provided is a downhole tool, a well system, and a method. The downhole tool, in one aspect, includes an expandable metal member positioned about a structure, the expandable metal member comprising a metal configured to expand in response to hydrolysis. The downhole tool, in accordance with this embodiment, further includes a dissimilar cathodic electric conductor isolated within the expandable metal member, the dissimilar cathodic electric conductor configured to initiate a galvanic corrosion effect to increase an expansion rate of the expandable metal member when a reactive fluid comes into contact with the dissimilar cathodic electric conductor and the expandable metal member.

26 Claims, 39 Drawing Sheets

DELAYED ACCELERATION OF EXPANDABLE METAL REACTION WITH GALVANIC CORROSION

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections. Wellbore anchors may also be used to fix one or more downhole tools within the wellbore.

BRIEF DESCRIPTION

Reference is now made to the following descriptions taken in conjunction with the accompanying drawings, in which.

Figure 1:
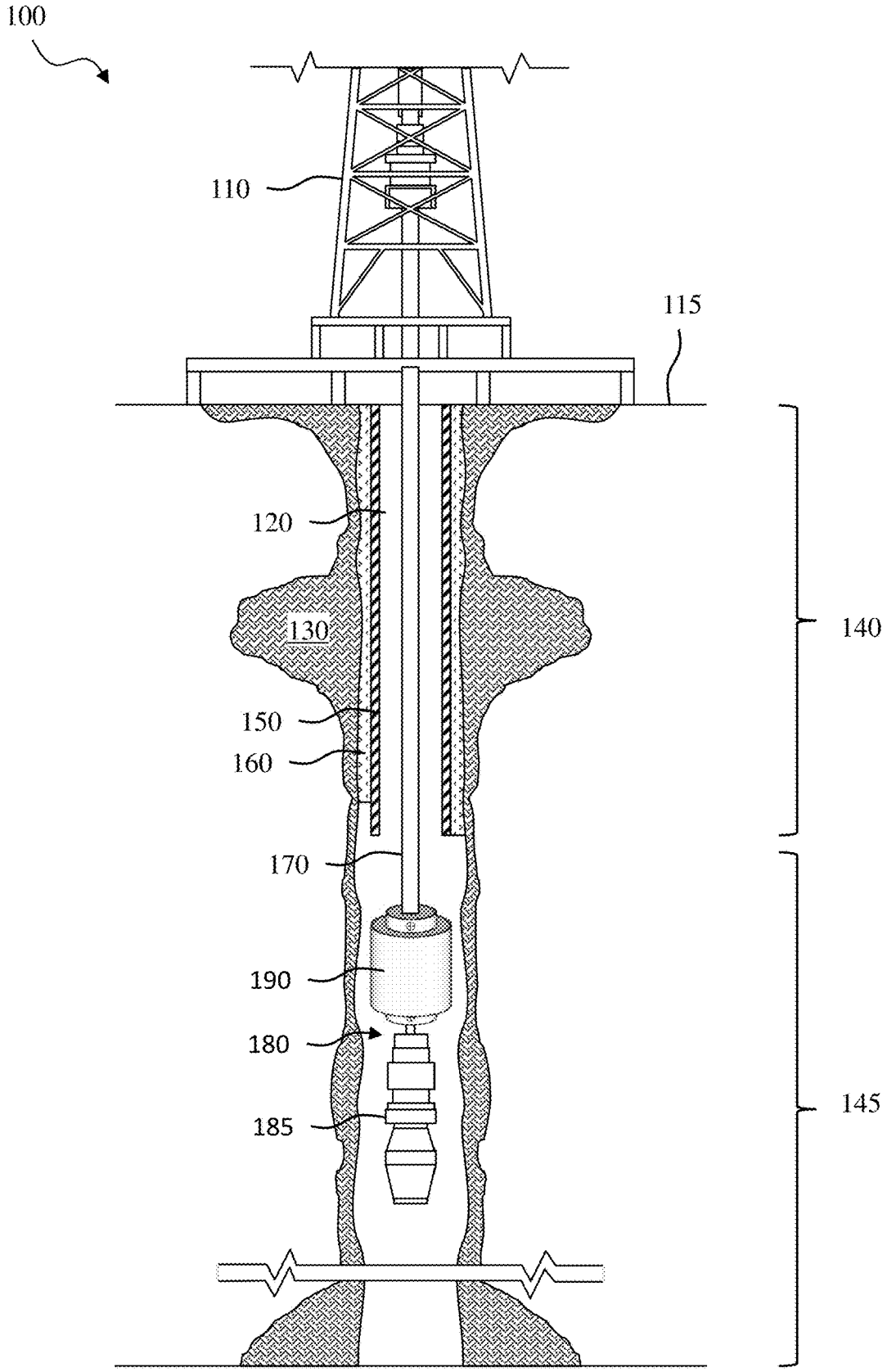
FIG. 1 illustrates a perspective view of a well system including an exemplary operating environment that the apparatuses, systems and methods disclosed herein may be employed.
Figure 2A:
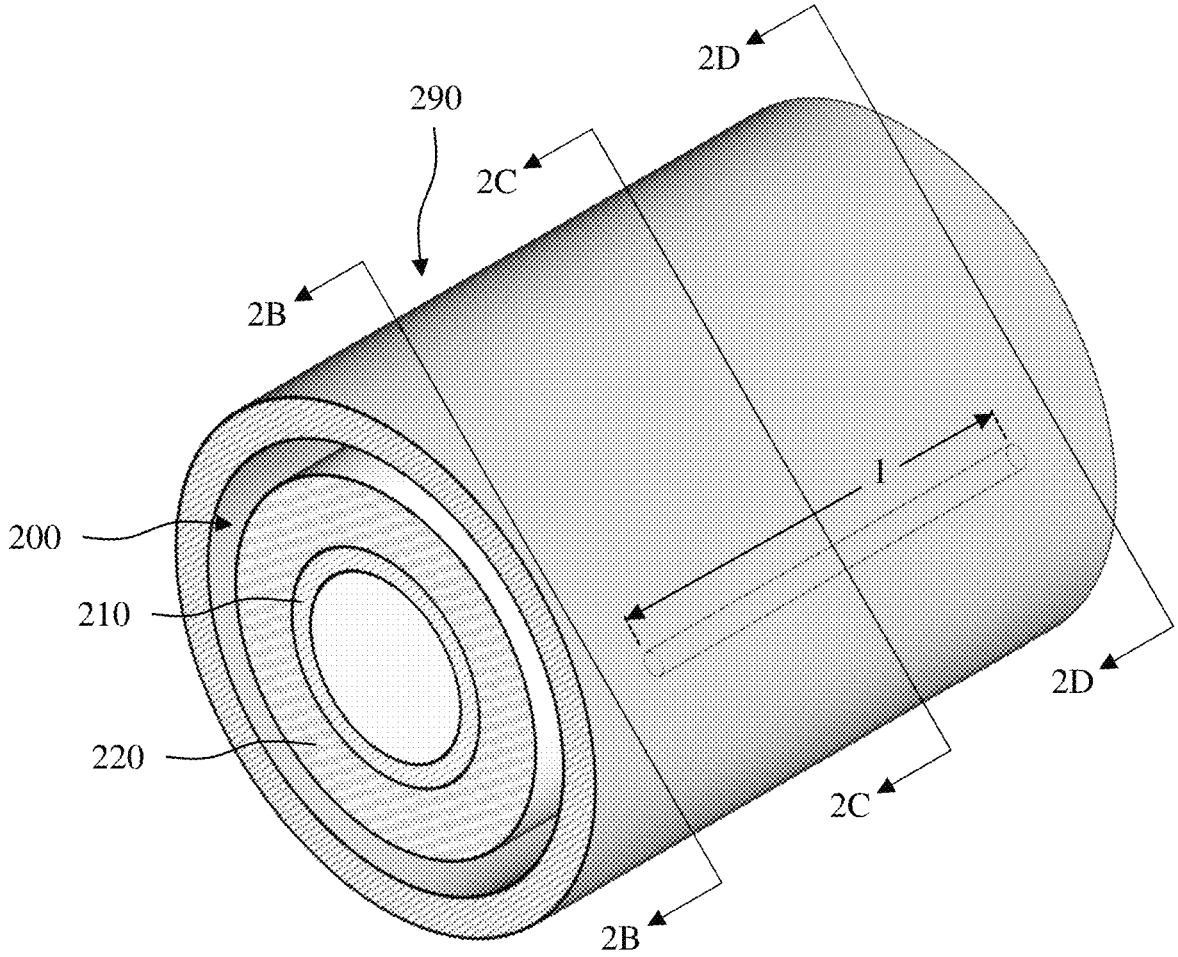
FIGS. 2A through 5D illustrate perspective views and a plurality of enlarged cross-sectional views of a downhole tool designed, manufactured and/or operated according to one or more embodiments of the disclosure and at different stages of deployment.
Figure 2B:
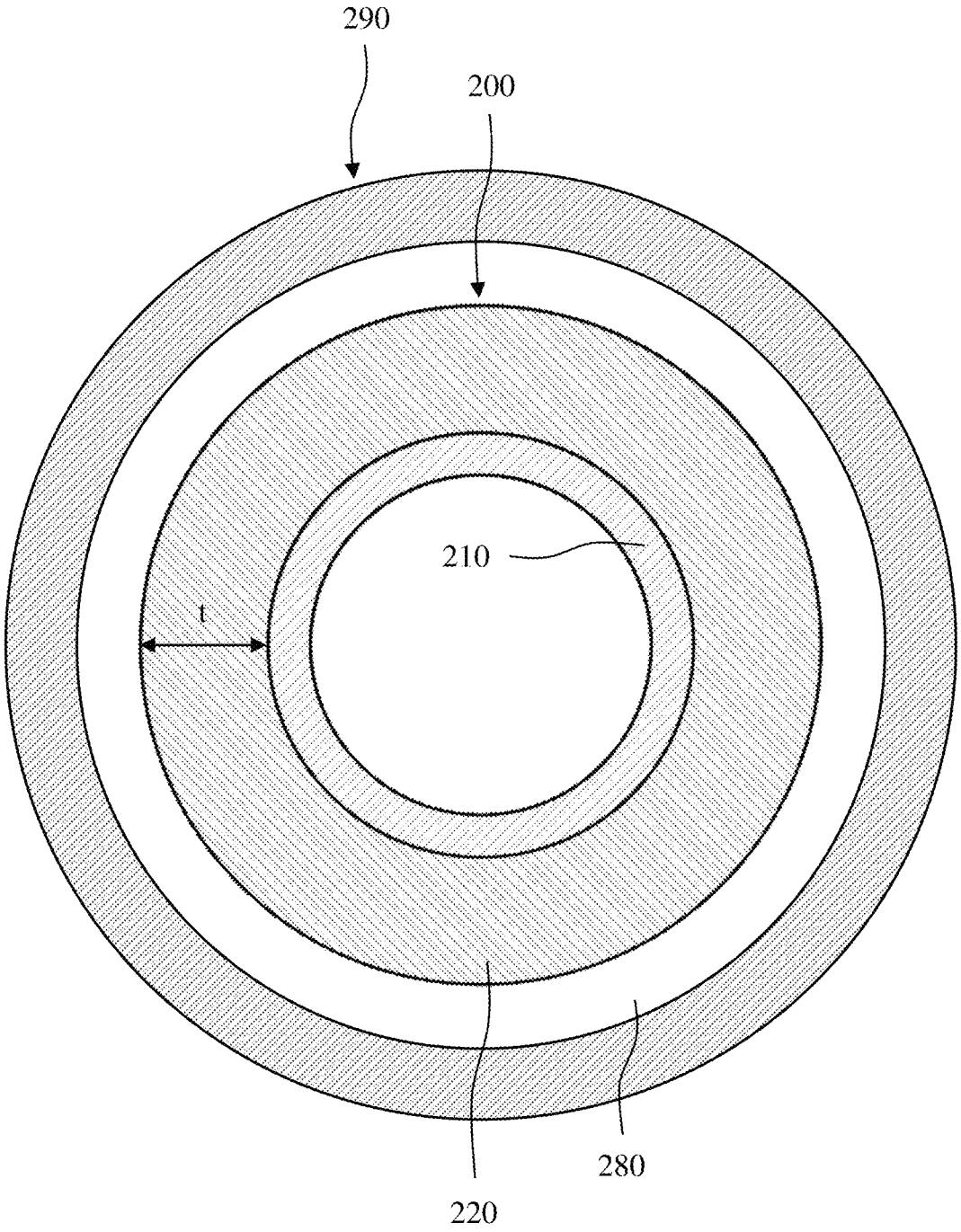
Figure 2C:
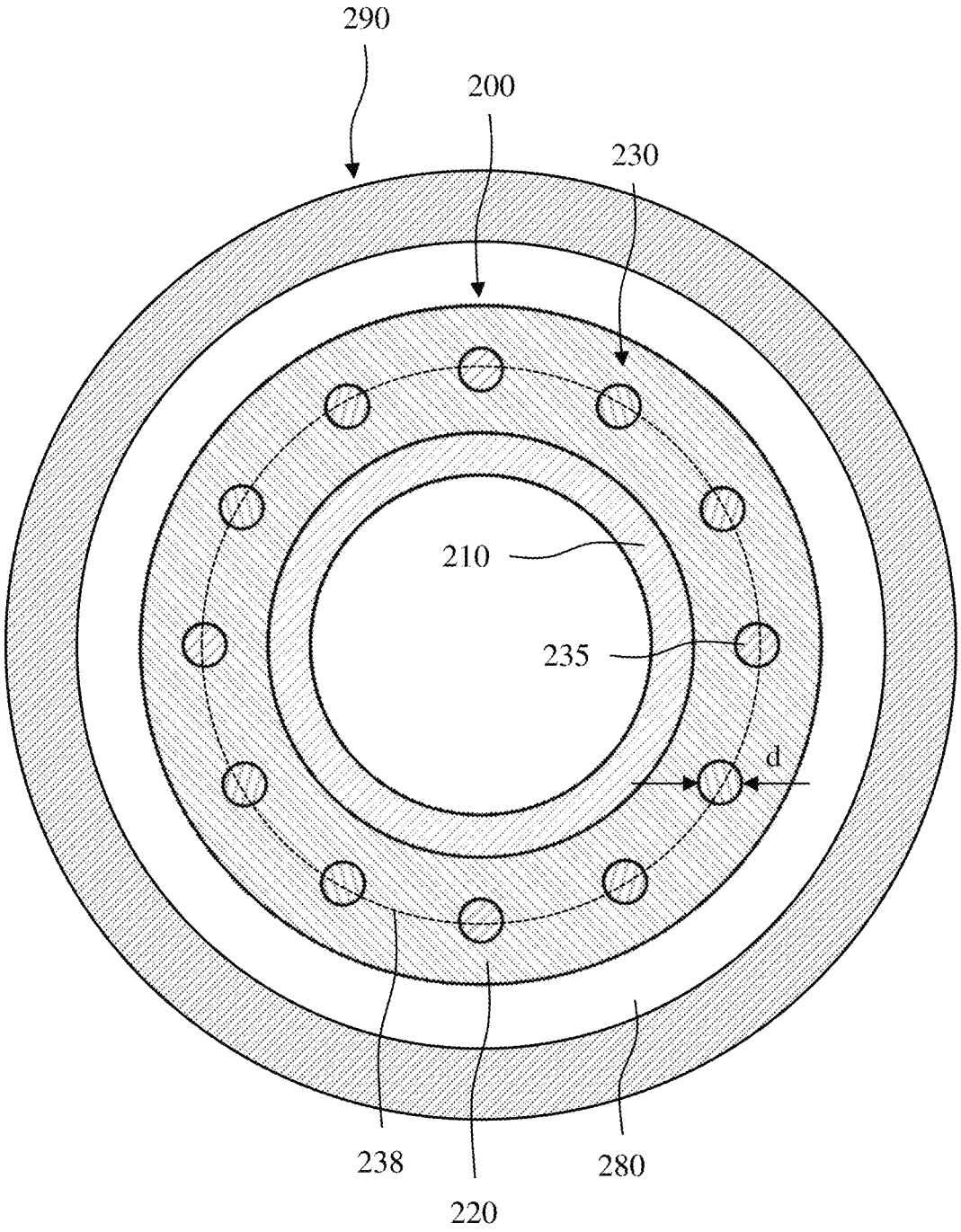
Figure 2D:
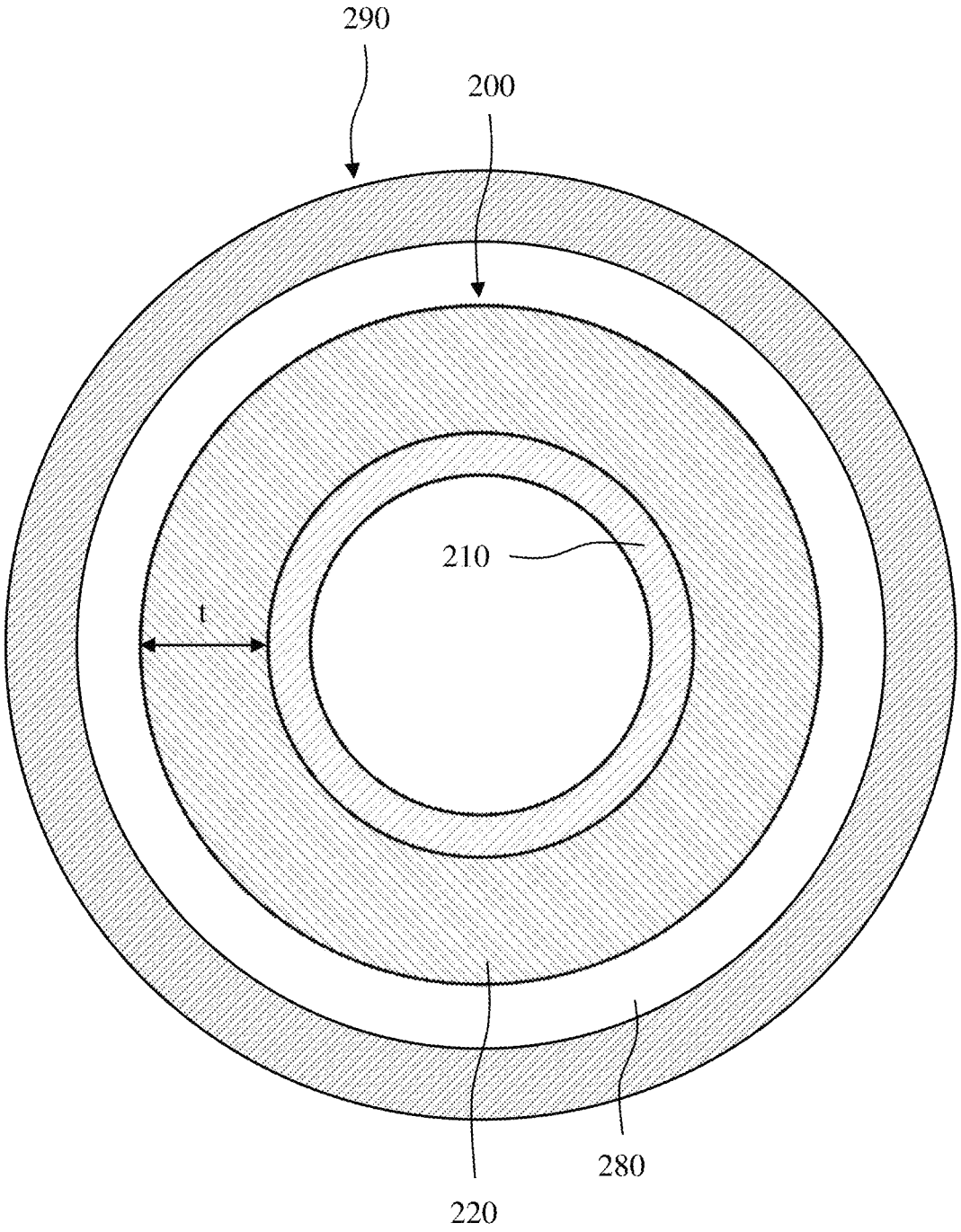
Figure 3A:
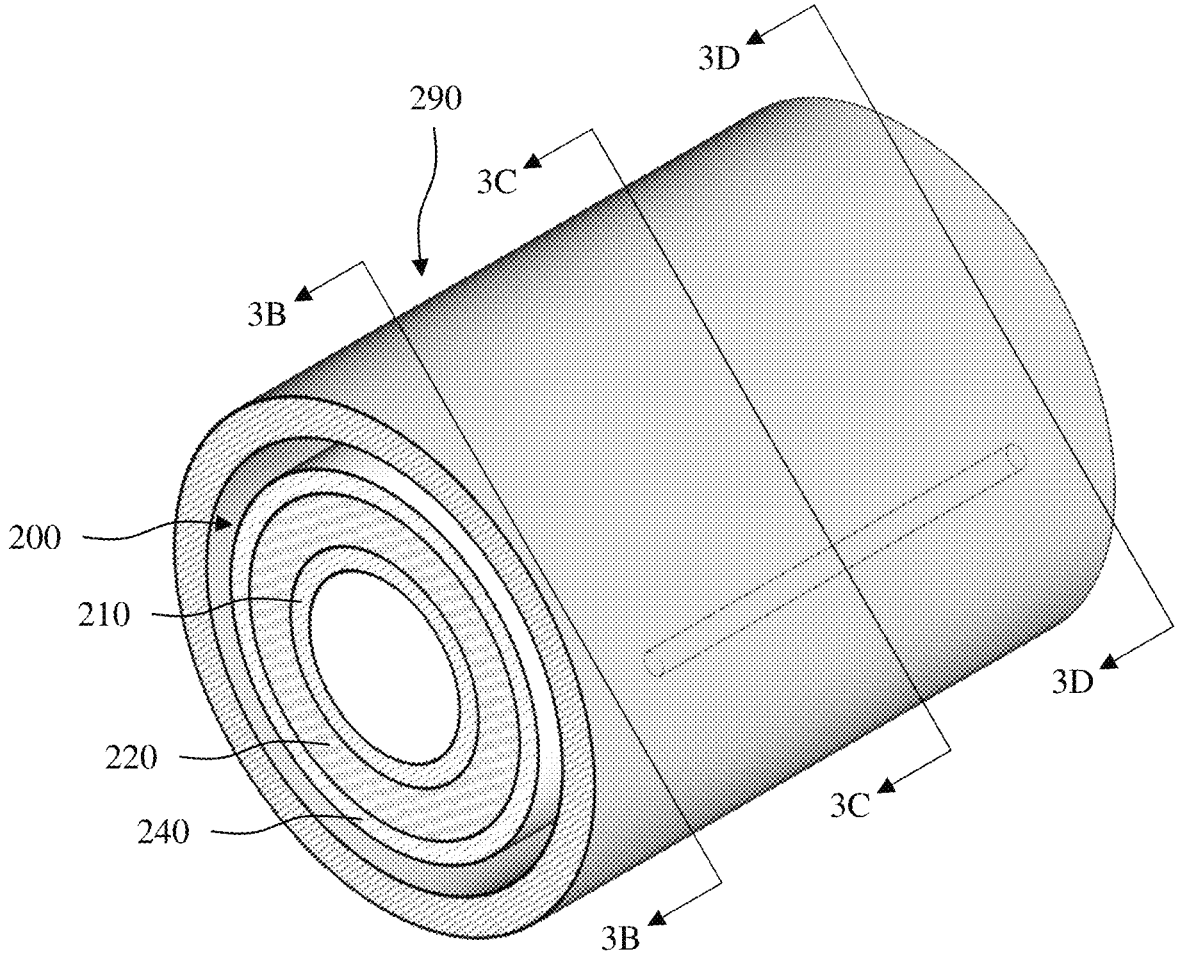
Figure 3B:
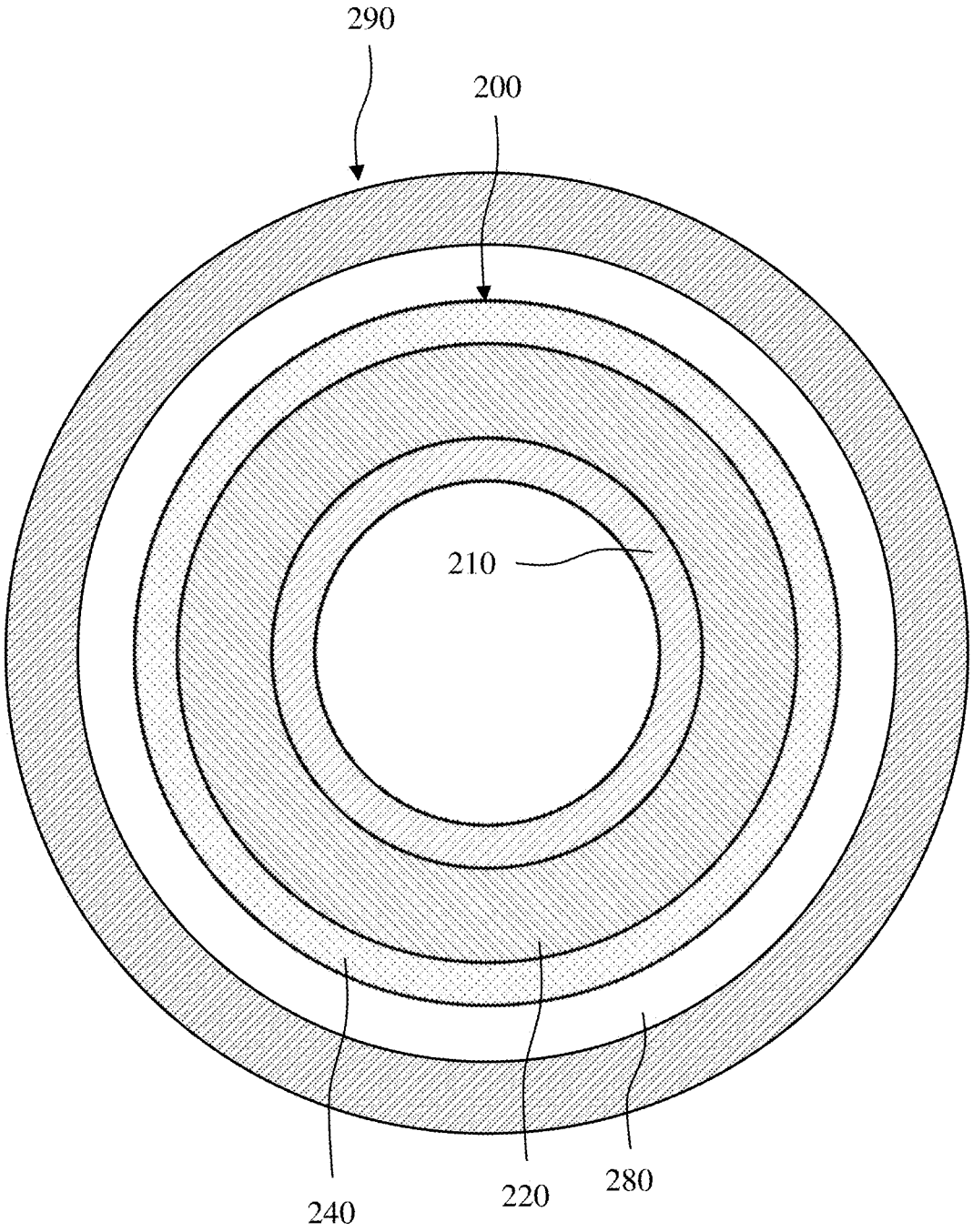
Figure 3C:
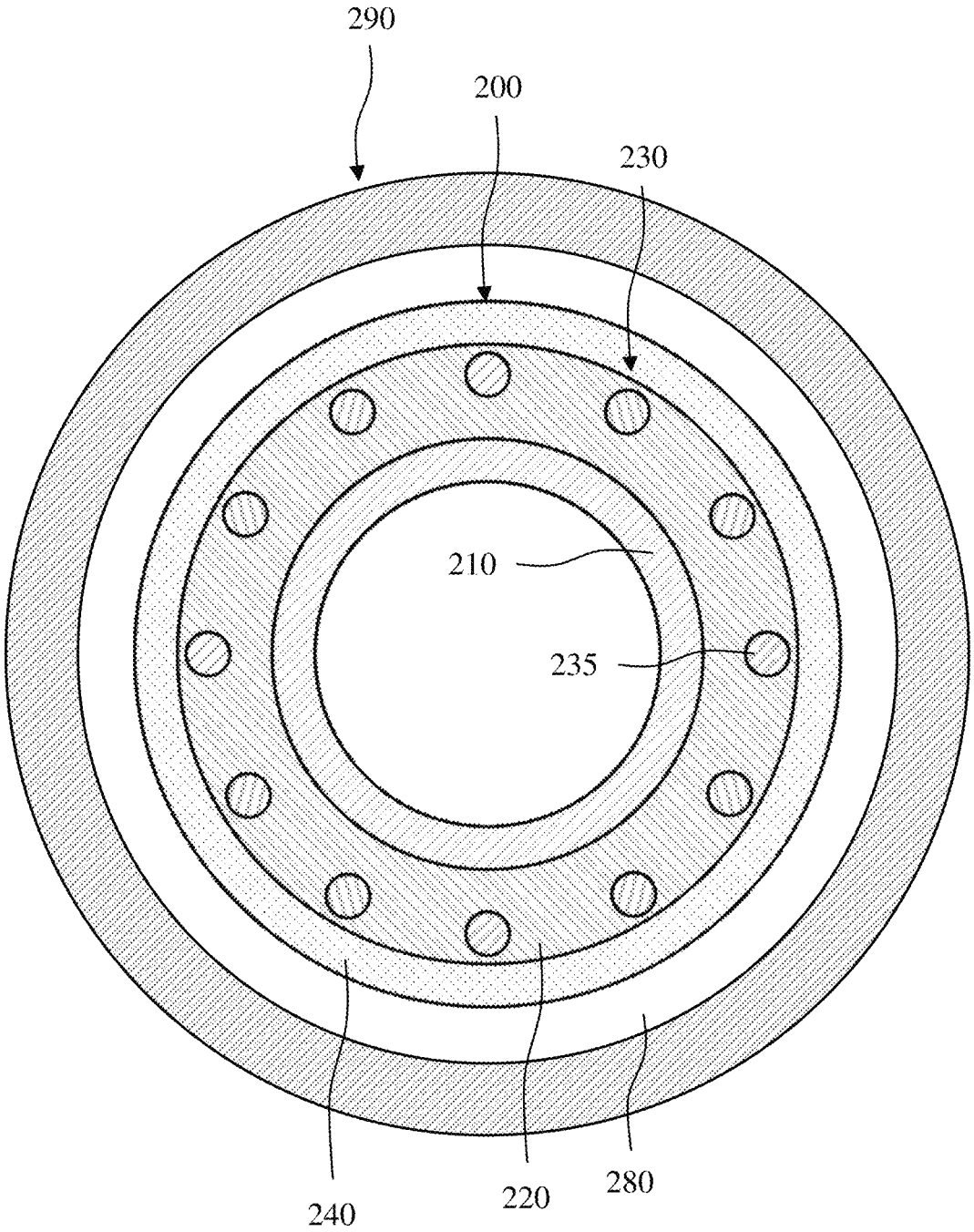
Figure 3D:
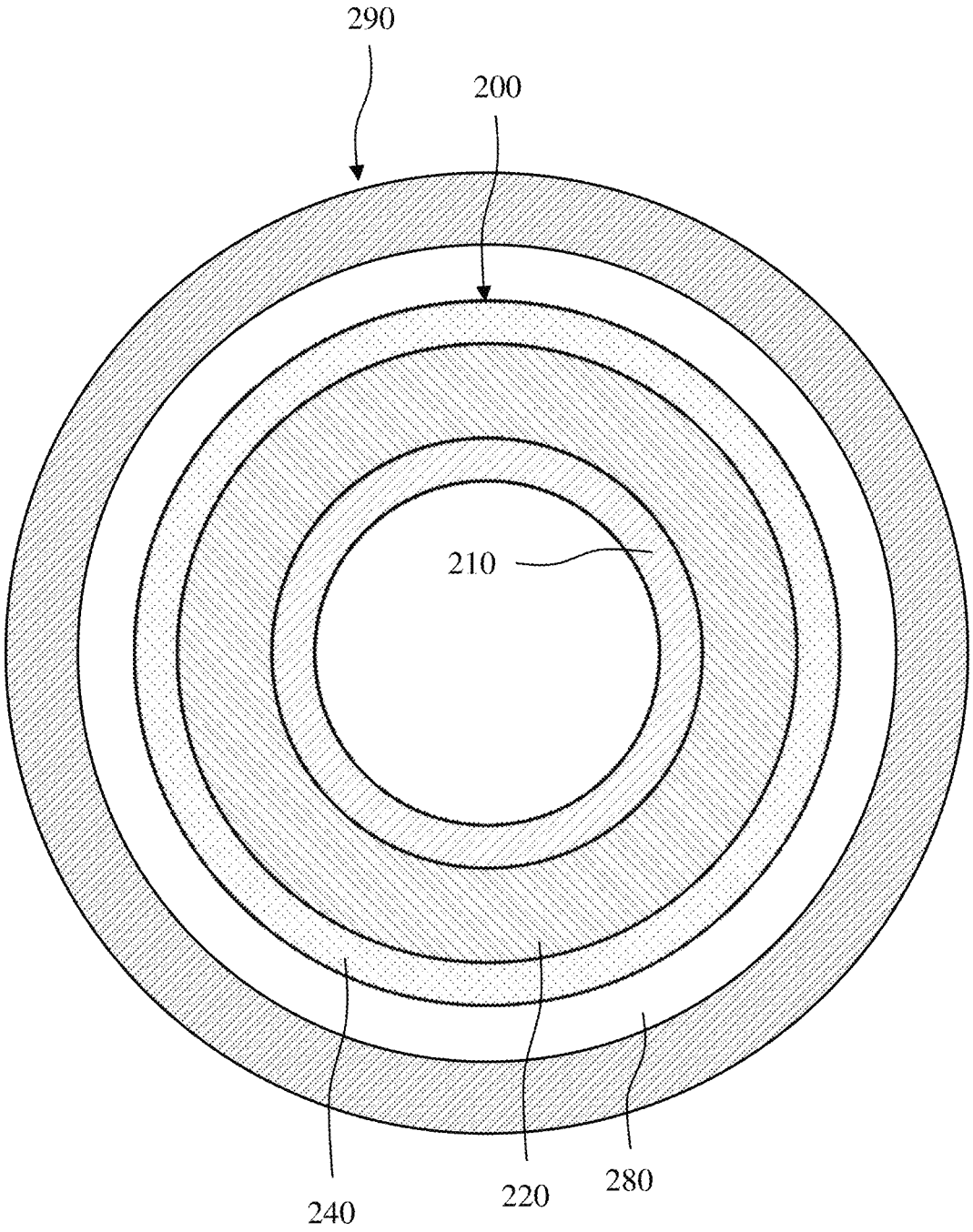
Figure 4A:
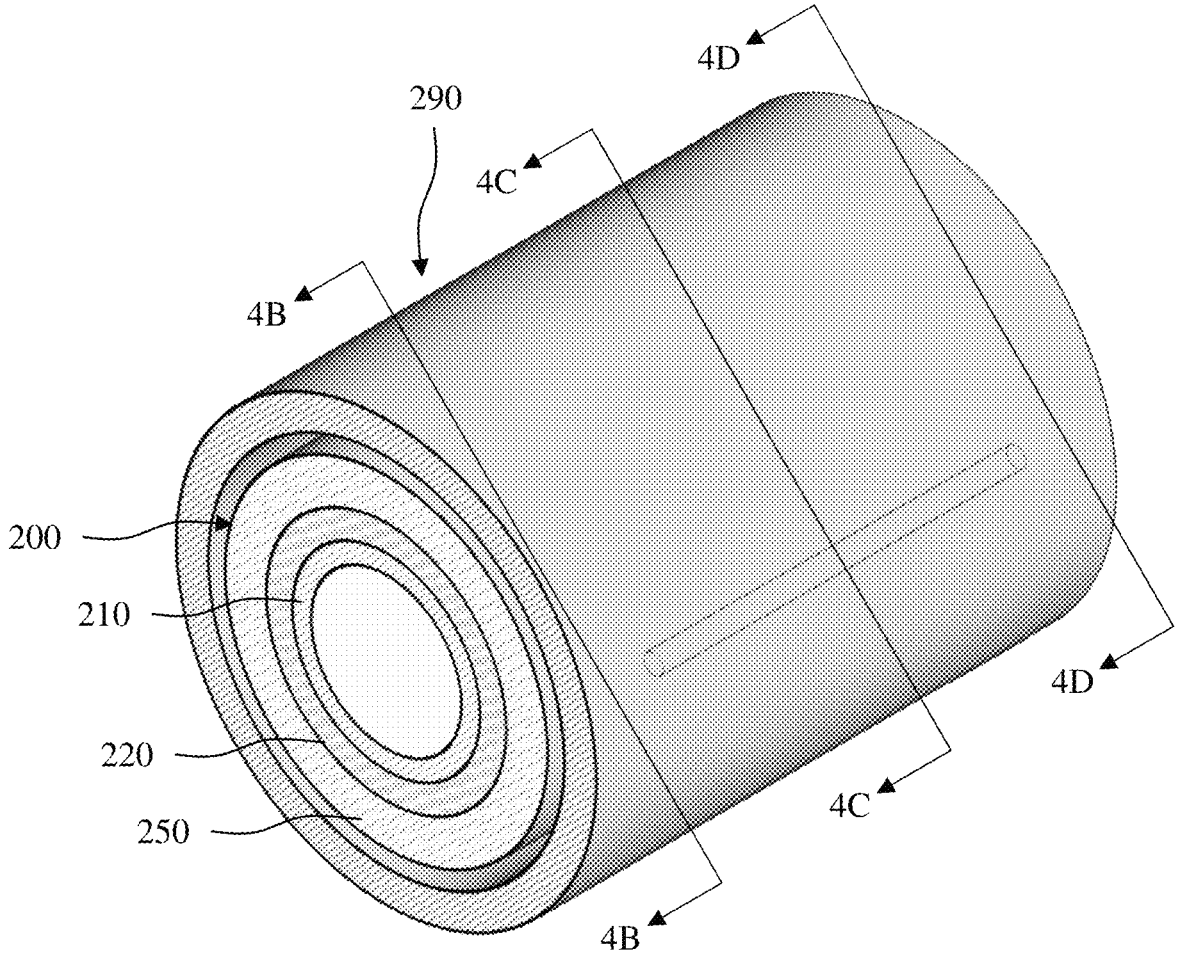
Figure 4B:
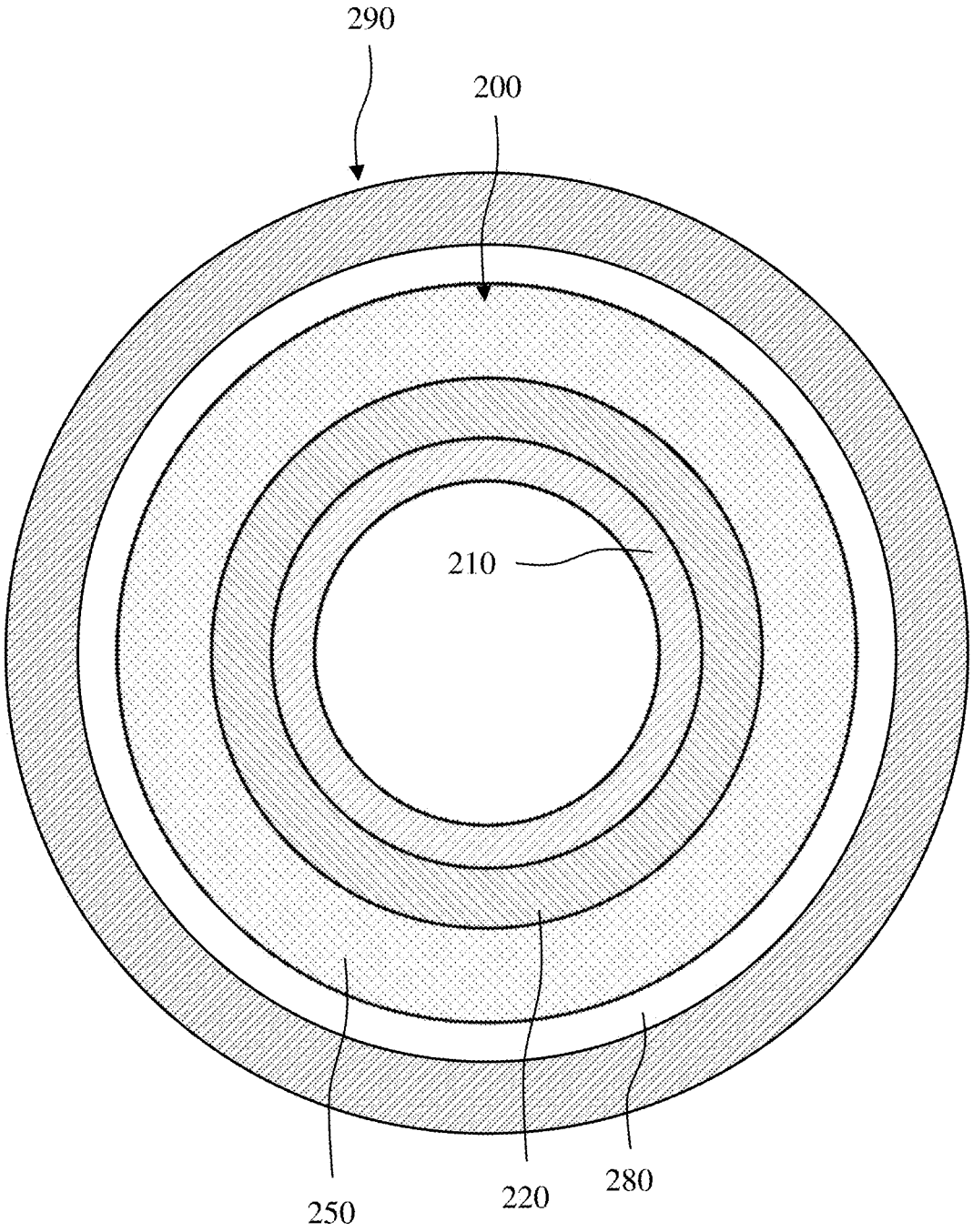
Figure 4C:
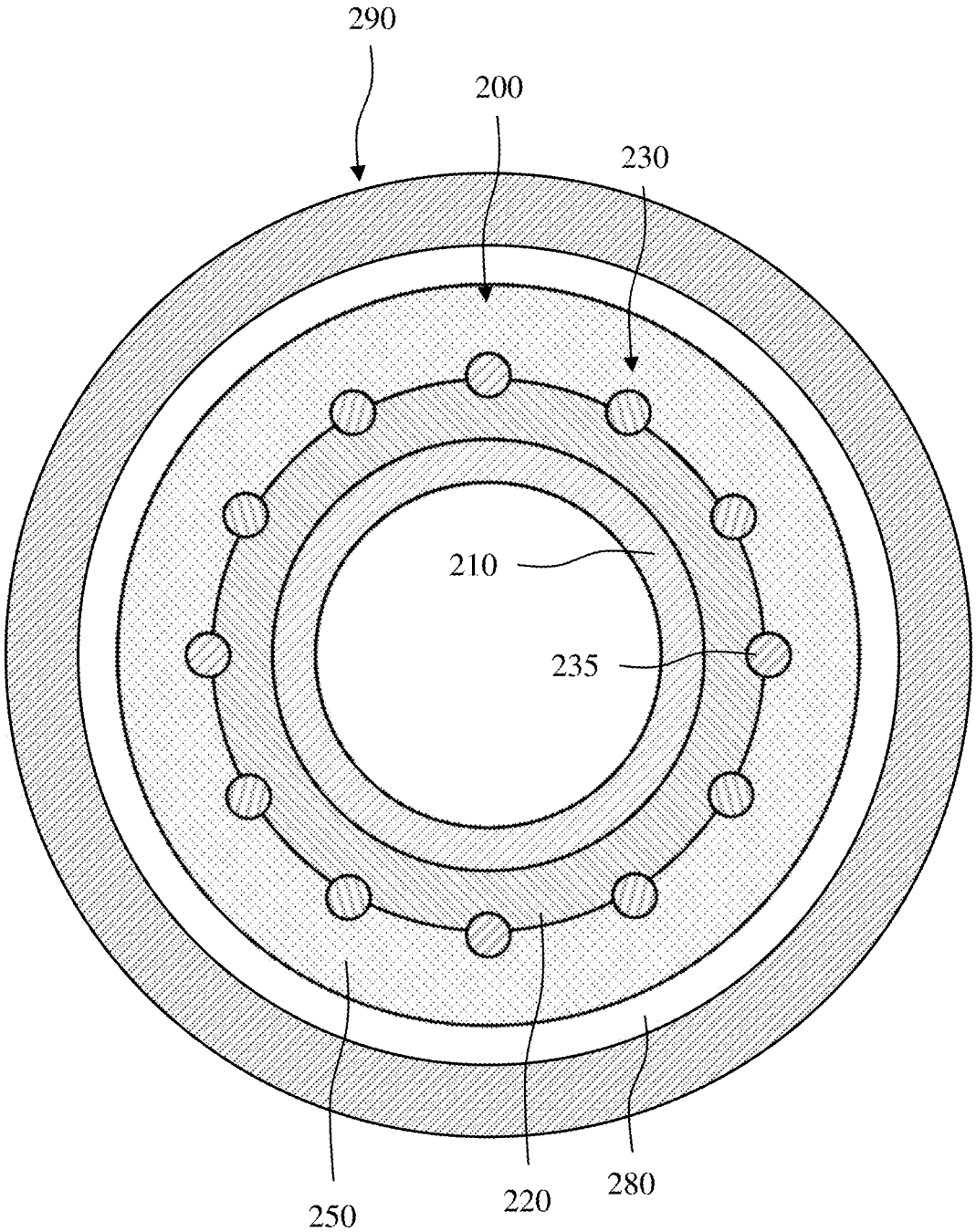
Figure 4D:
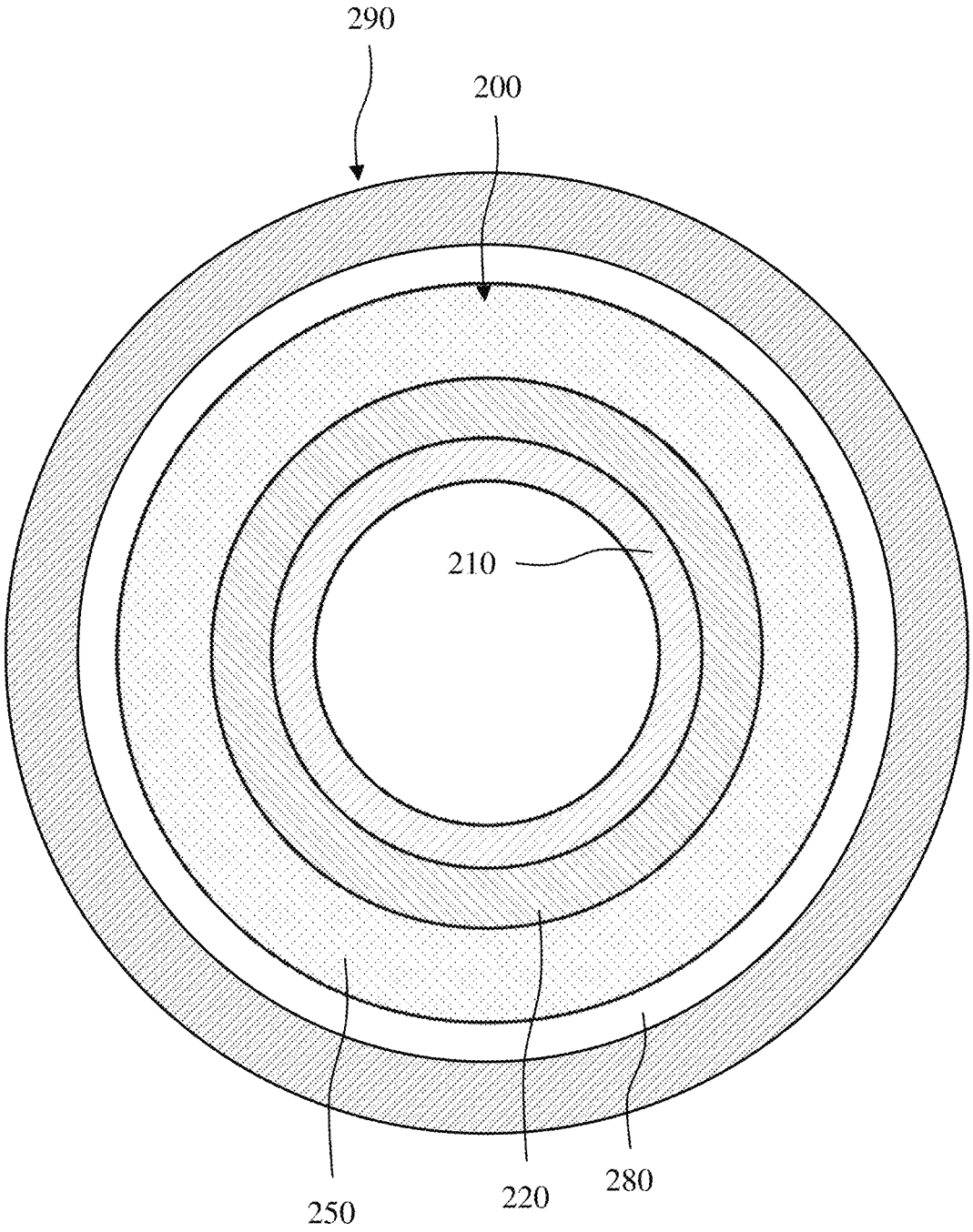
Figure 5A:
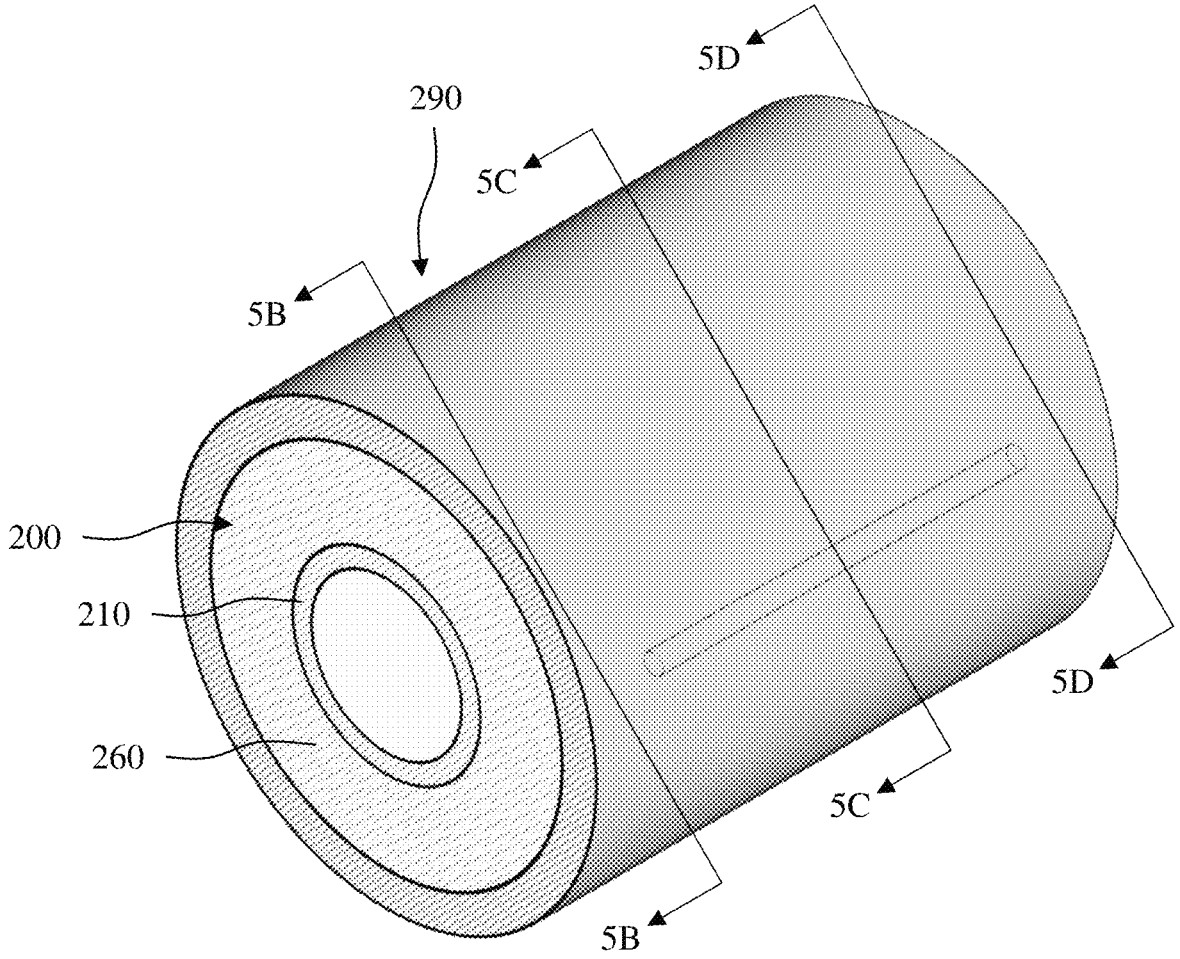
Figure 5B:
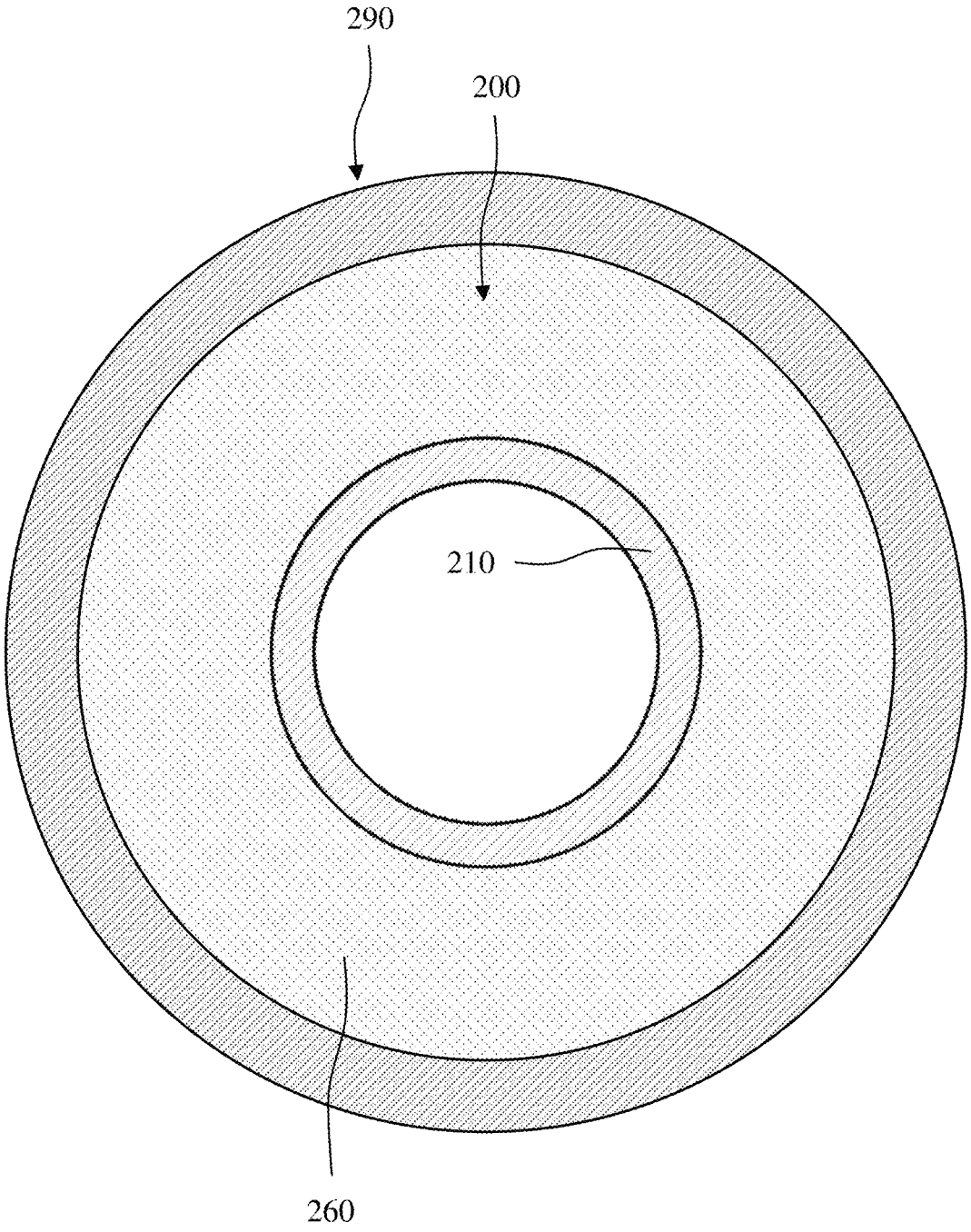
Figure 5C:
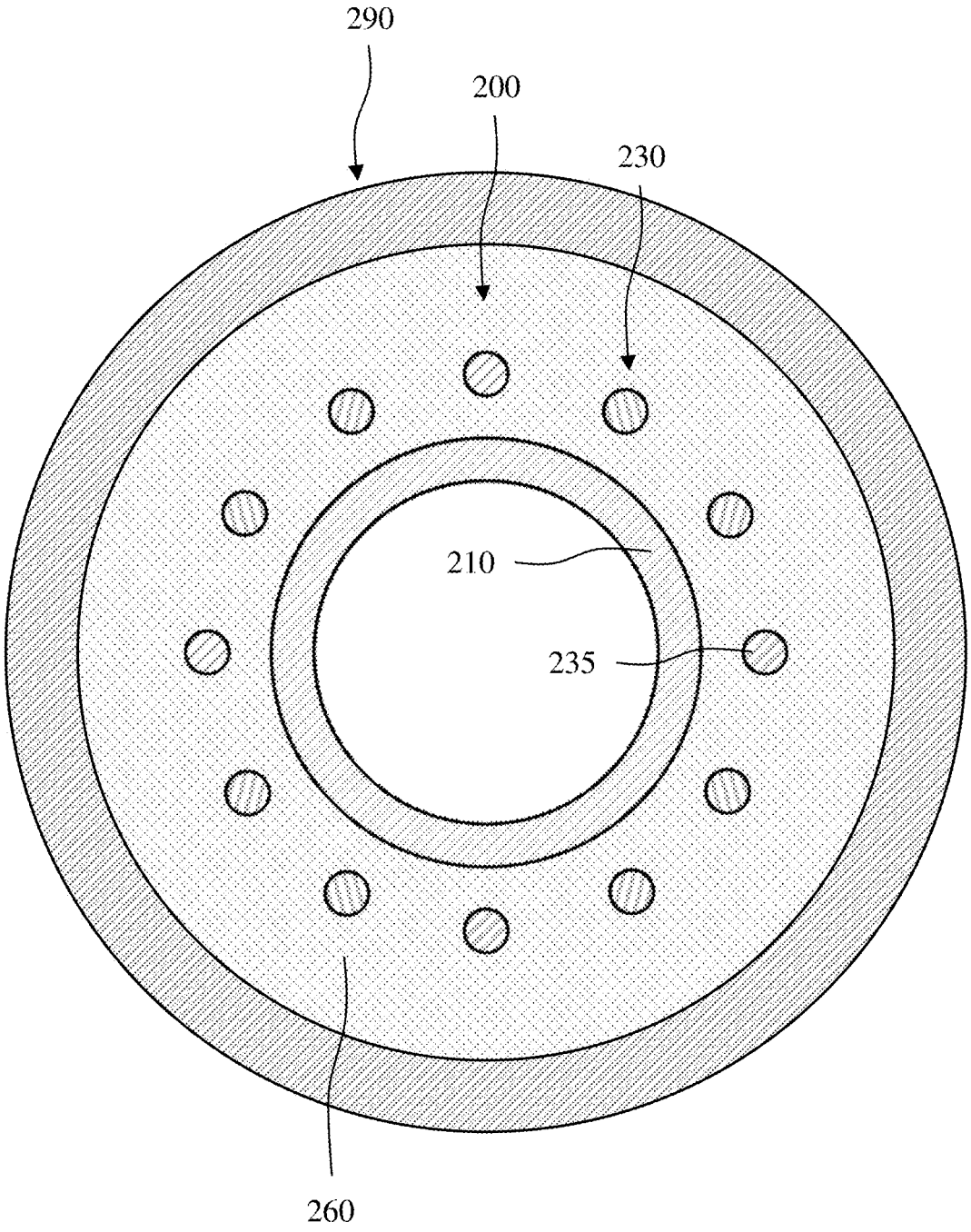
Figure 5D:
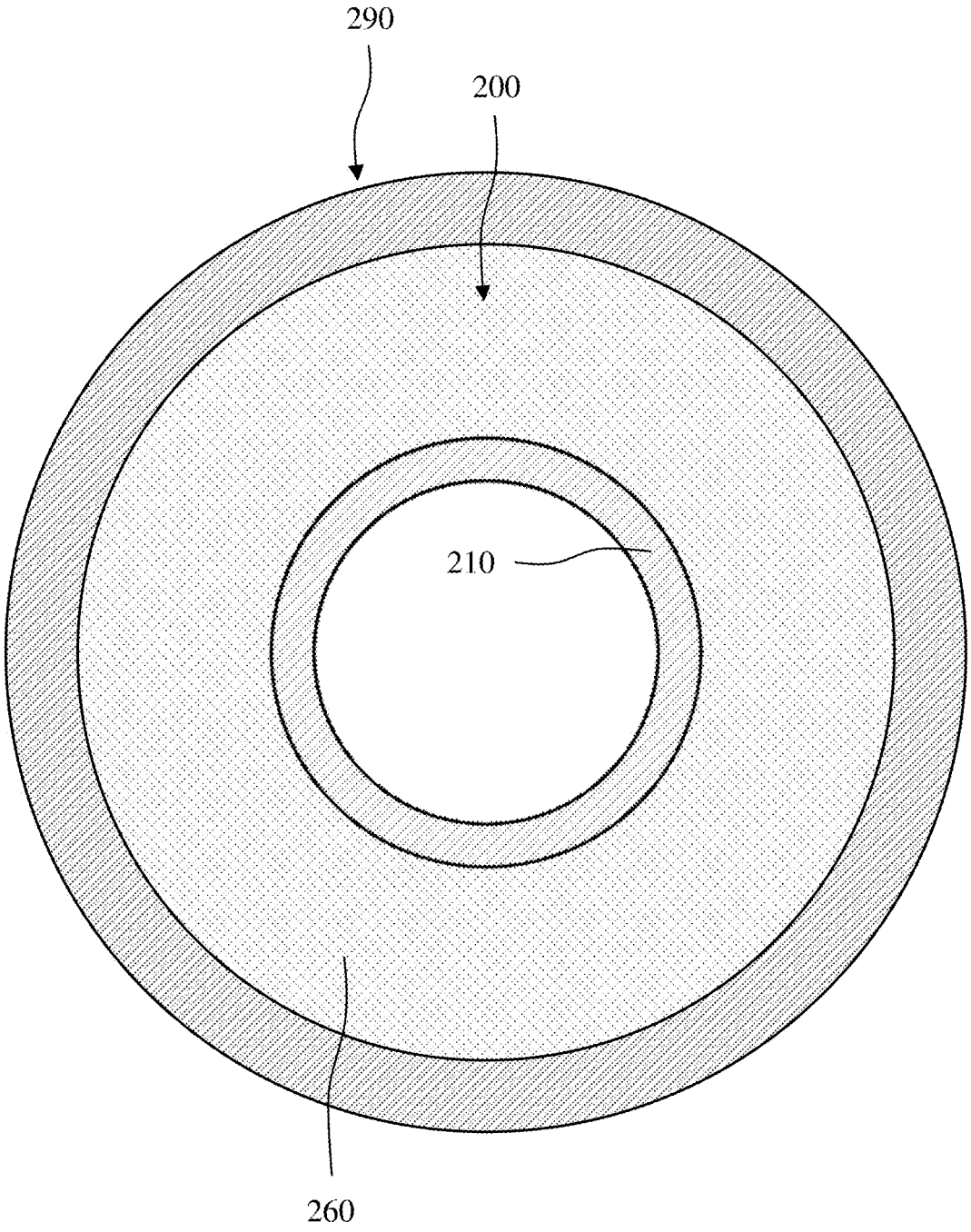
Figure 6A:
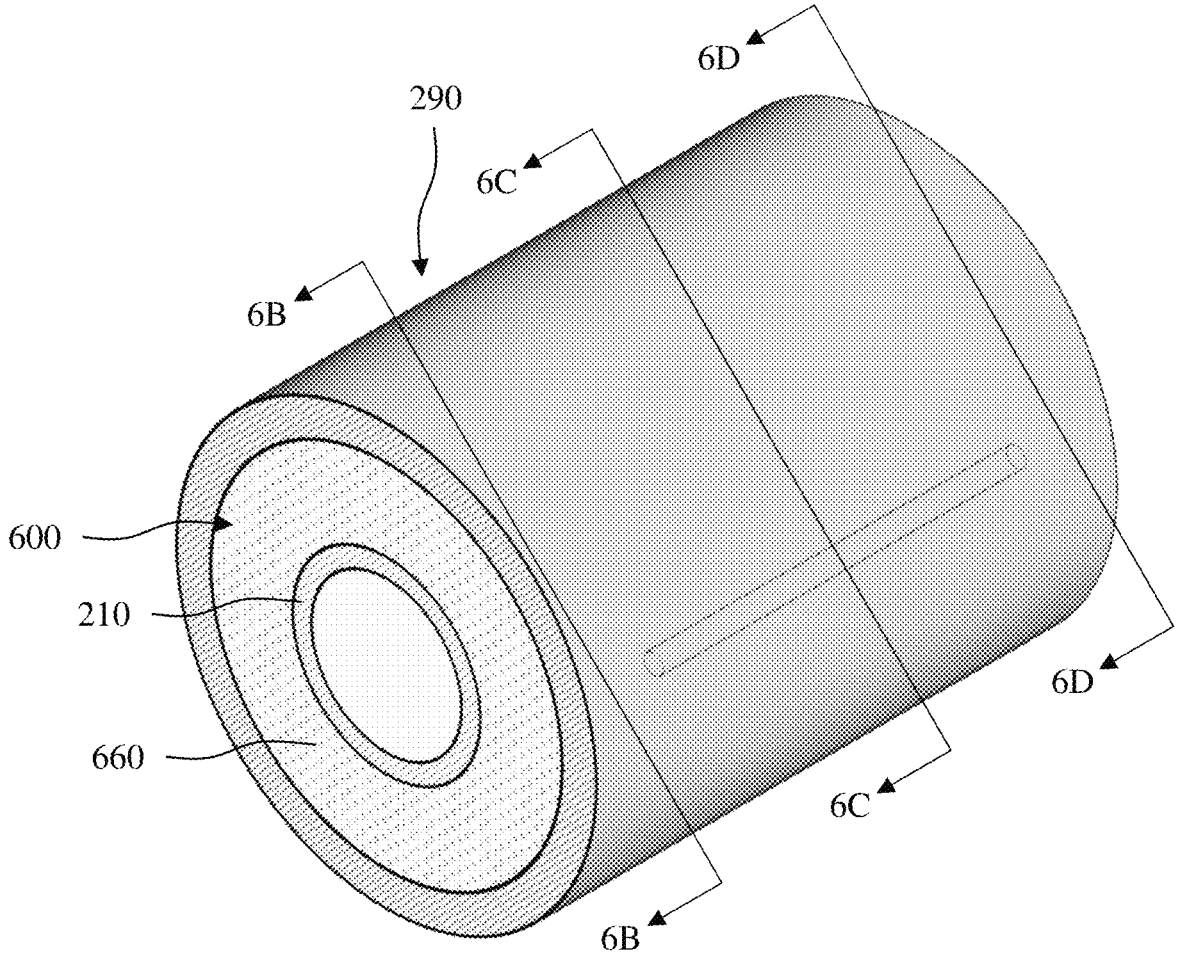
FIGS. 6A through 6D illustrate a perspective view and a plurality of enlarged cross-sectional views of a downhole tool designed, manufactured and/or operated according to one or more alternative embodiments of the disclosure after at least partially completing a setting phase.
Figure 6B:
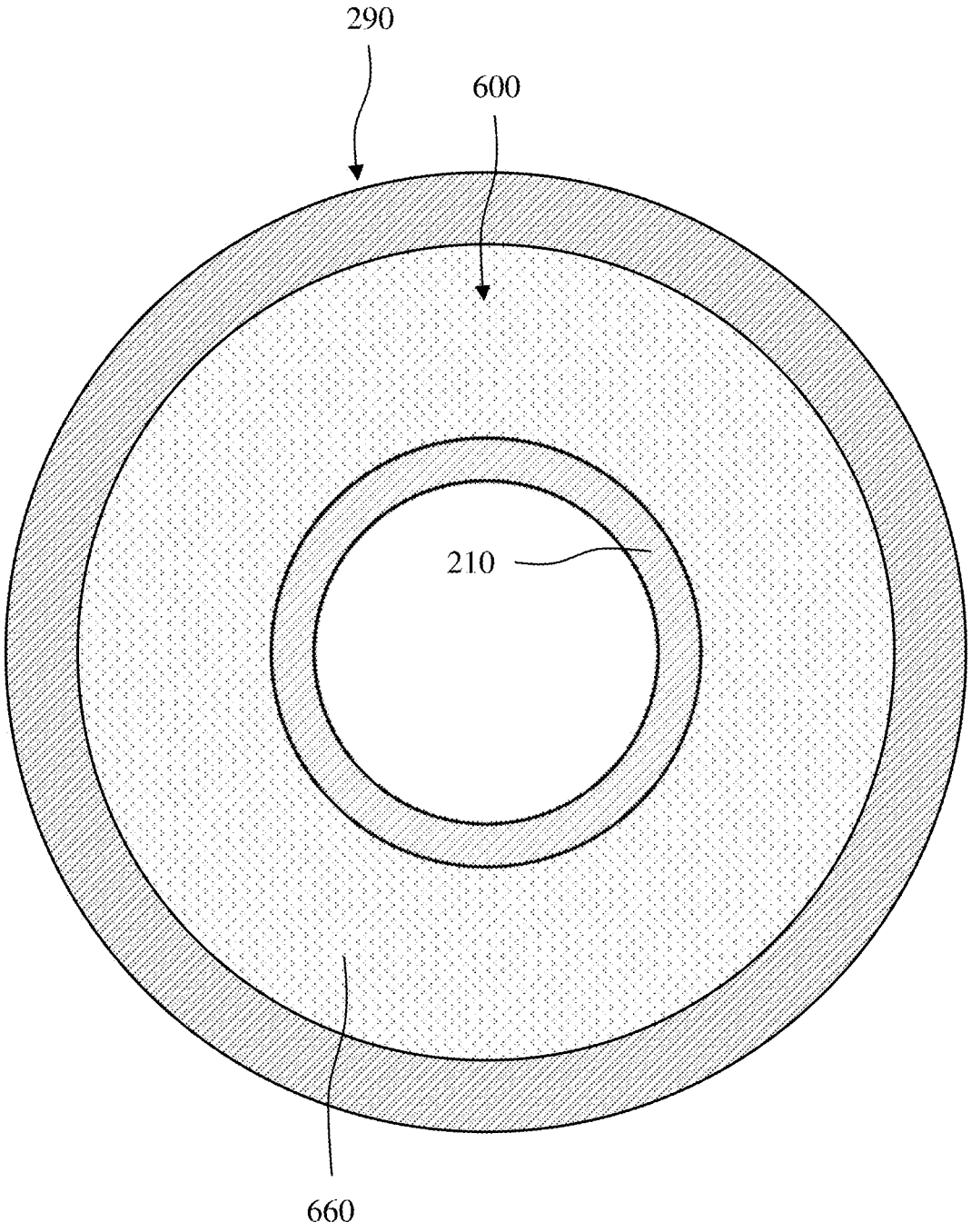
Figure 6C:
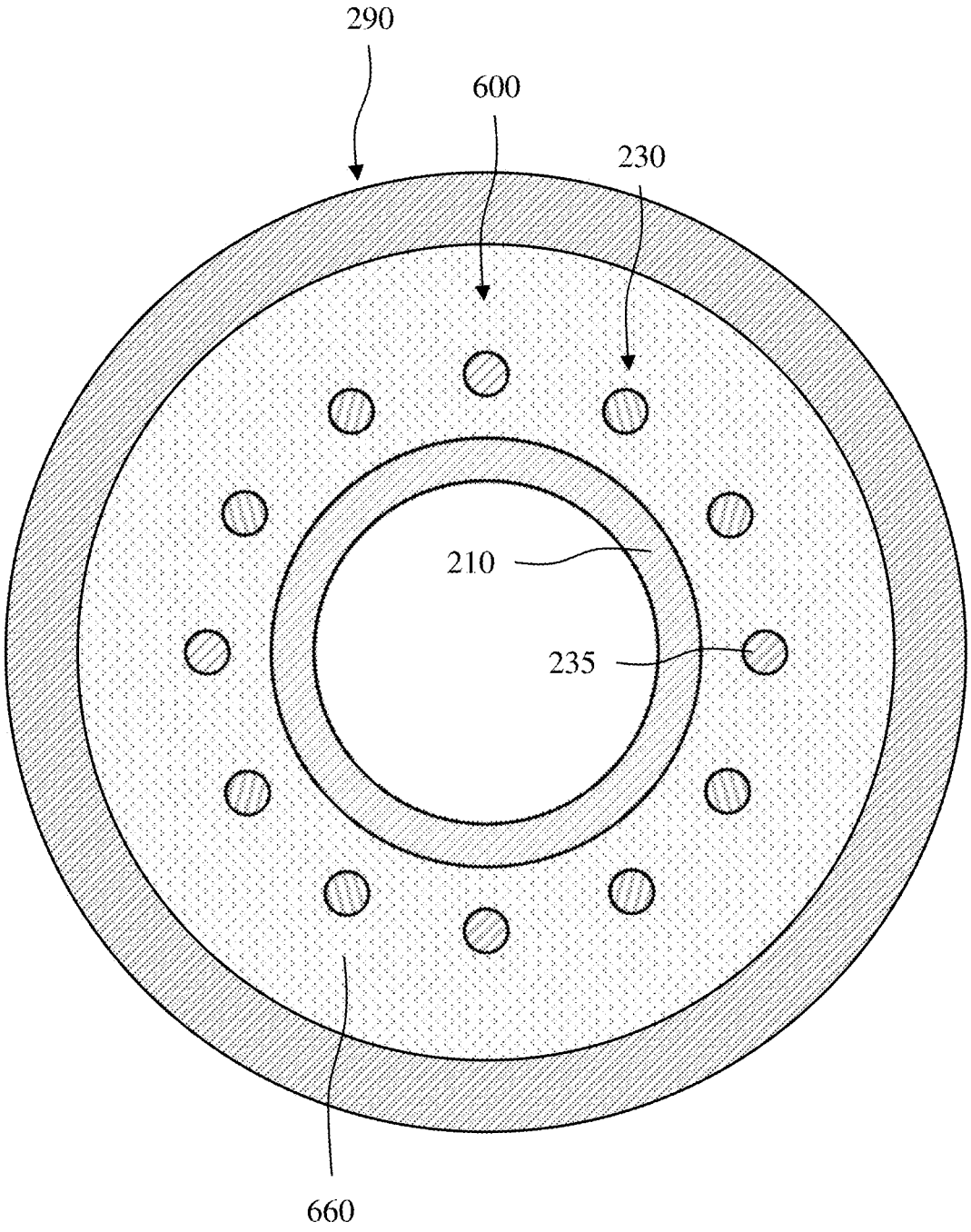
Figure 6D:
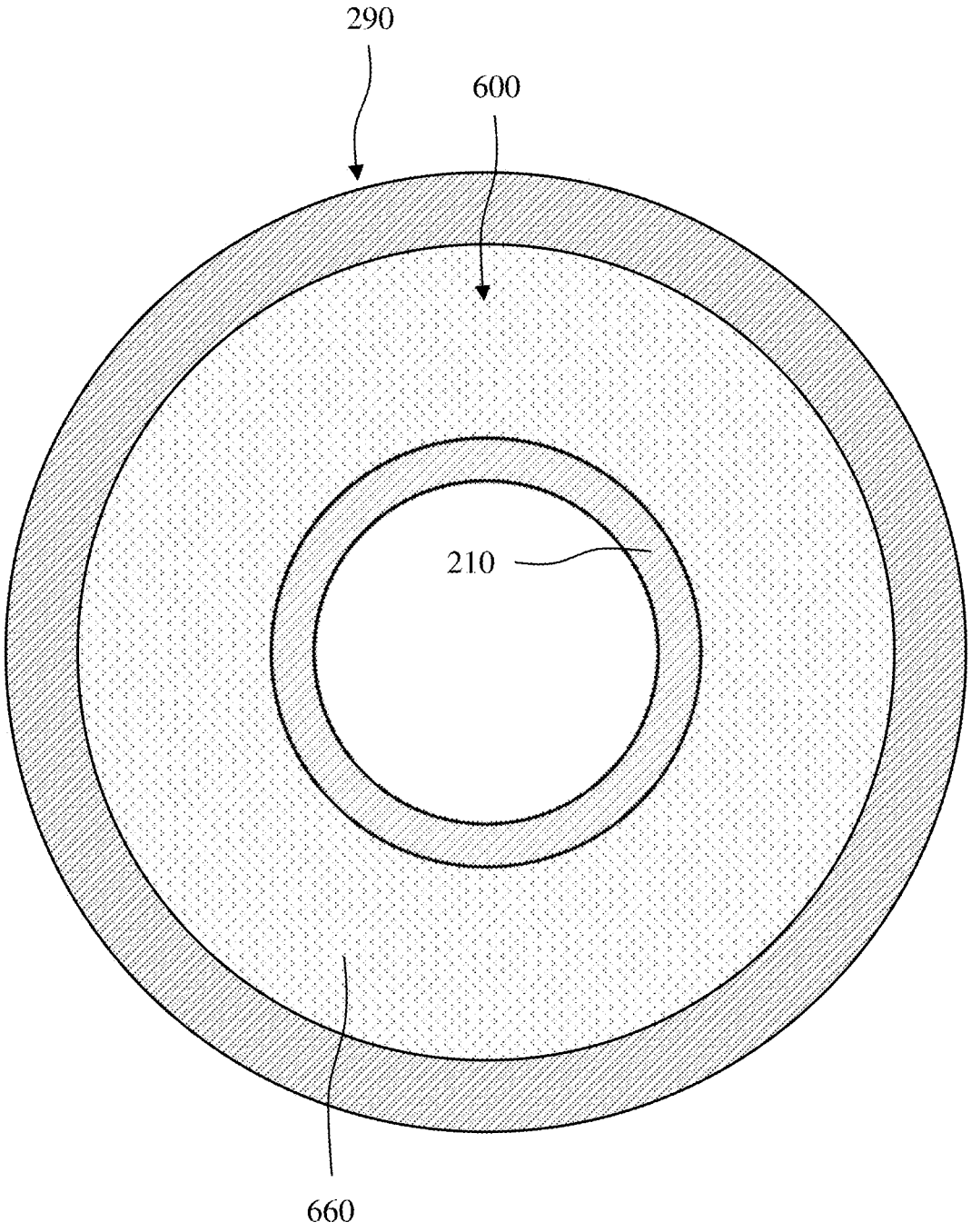
Figure 7A:
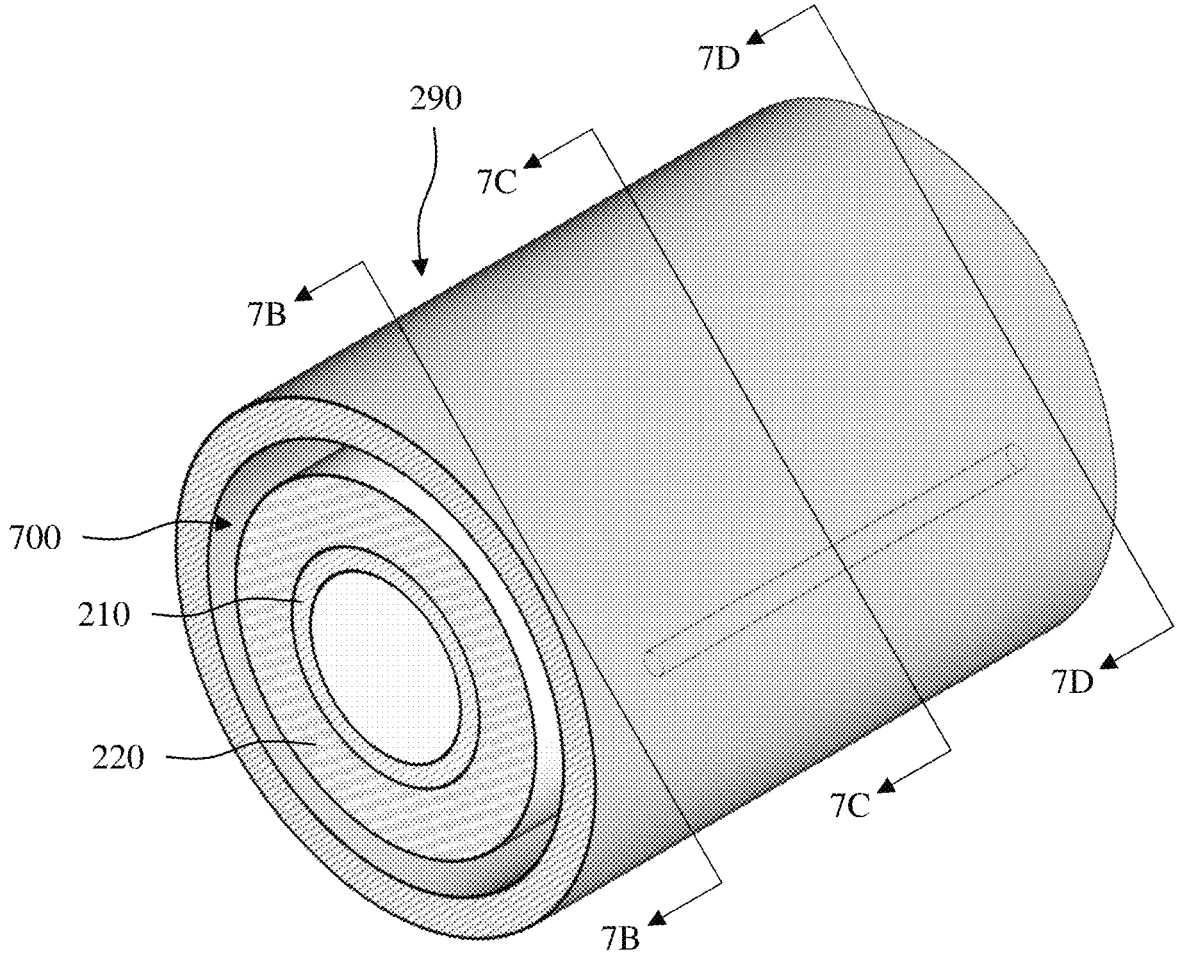
FIGS. 7A through 7D illustrate a perspective view and a plurality of enlarged cross-sectional views of a downhole tool designed, manufactured and/or operated according to one or more alternative embodiments of the disclosure.
Figure 7B:
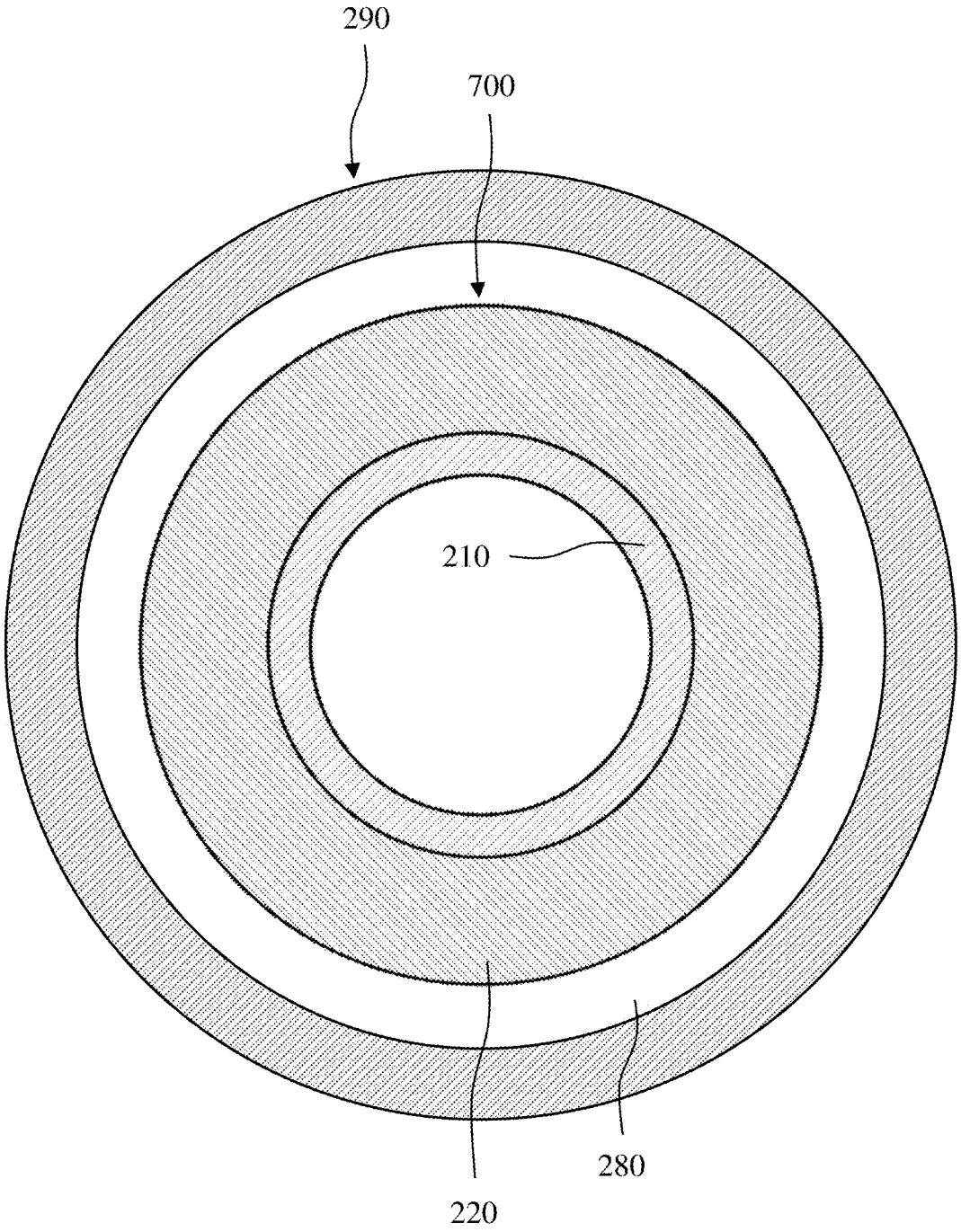
Figure 7C:
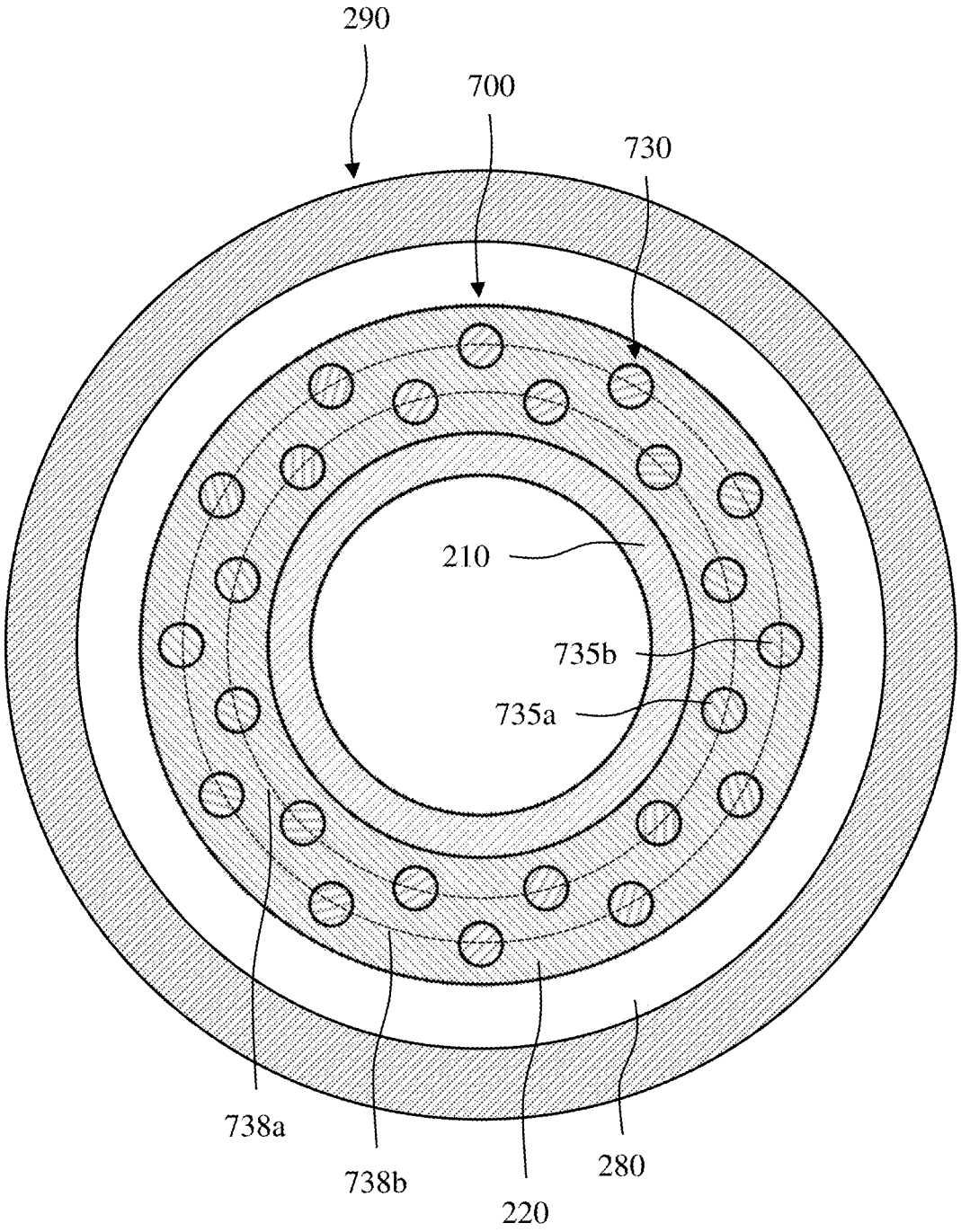
Figure 7D:
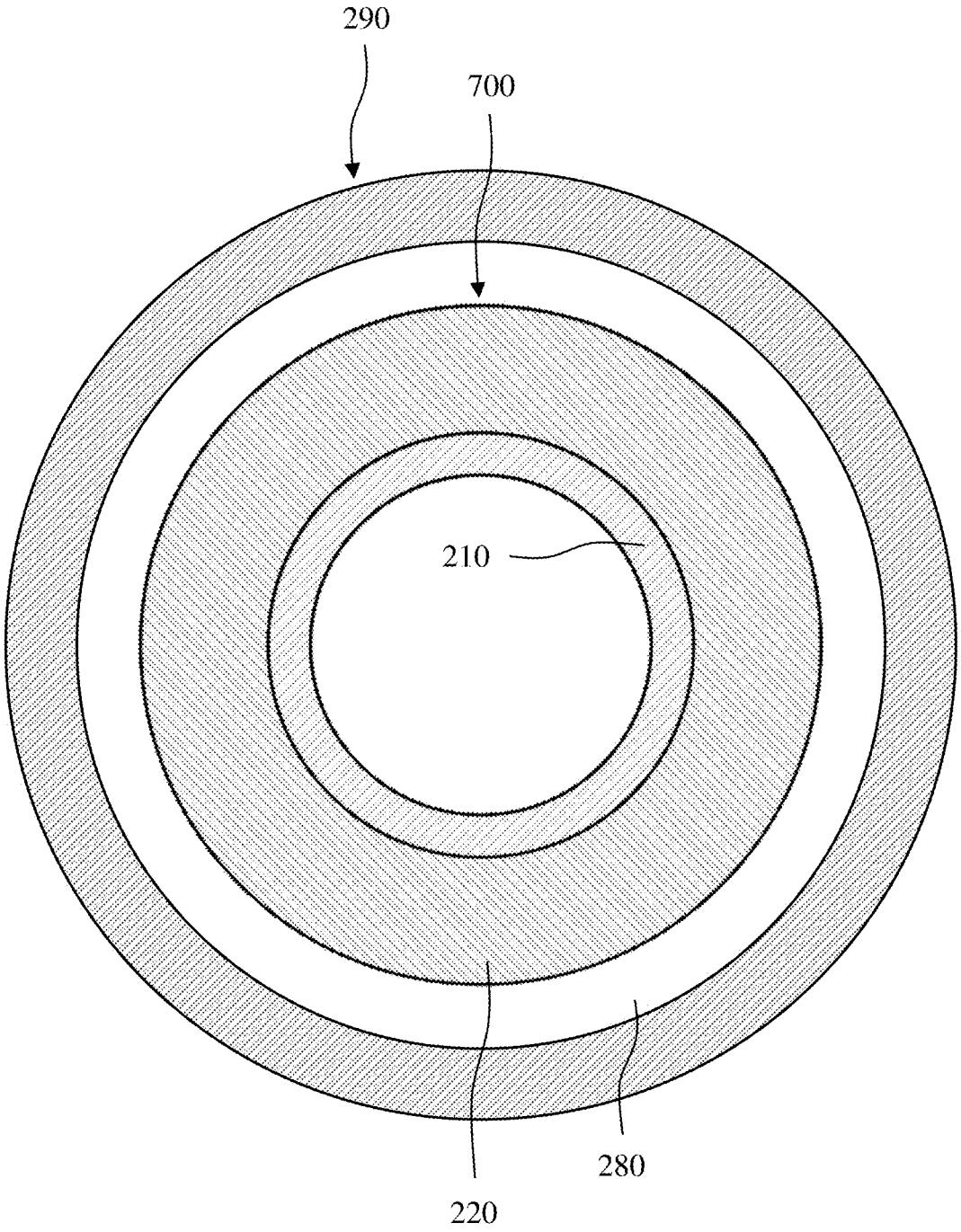
Figure 8A:
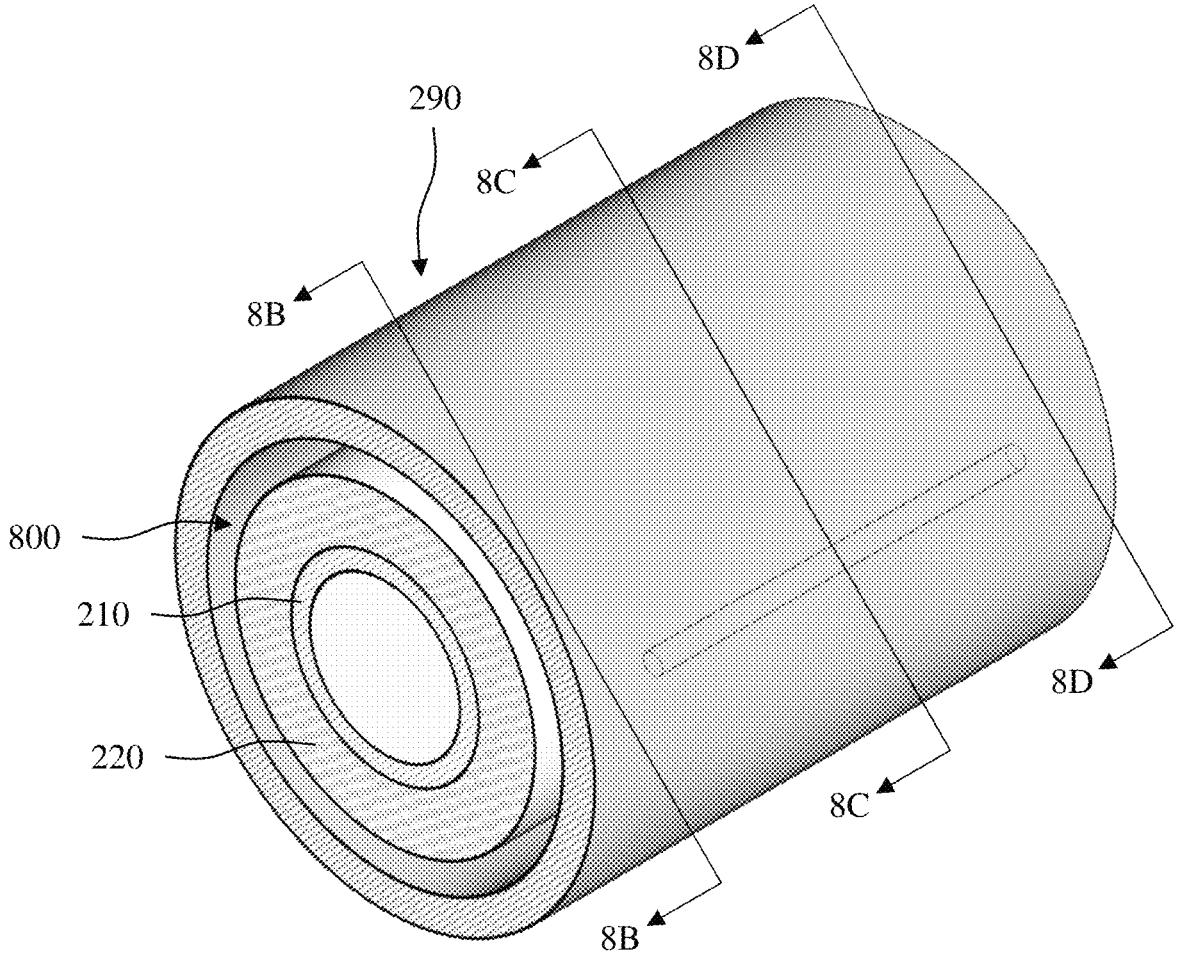
FIGS. 8A through 8D illustrate a perspective view and a plurality of enlarged cross-sectional views of a downhole tool designed, manufactured and/or operated according to one or more alternative embodiments of the disclosure.
Figure 8B:
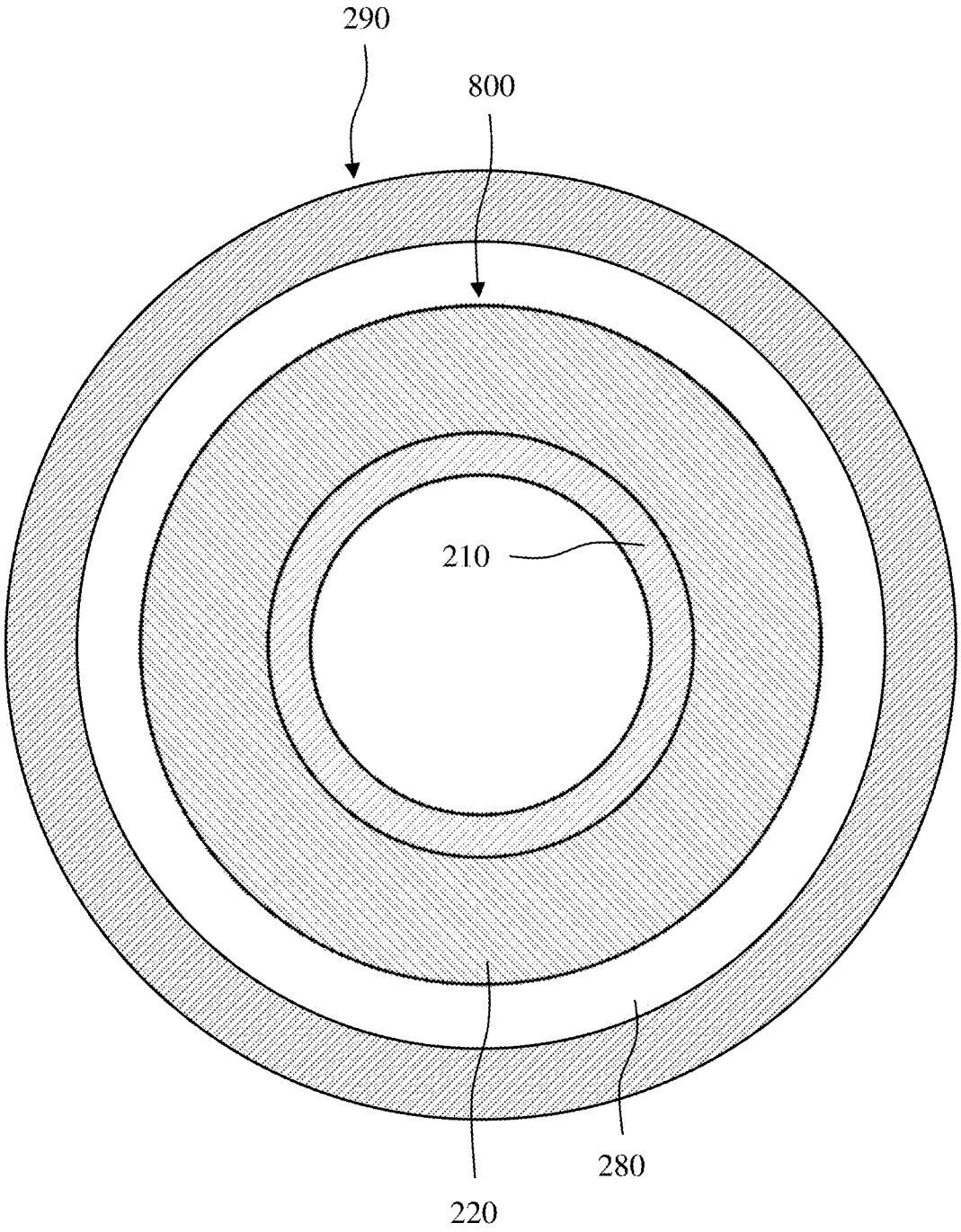
Figure 8C:
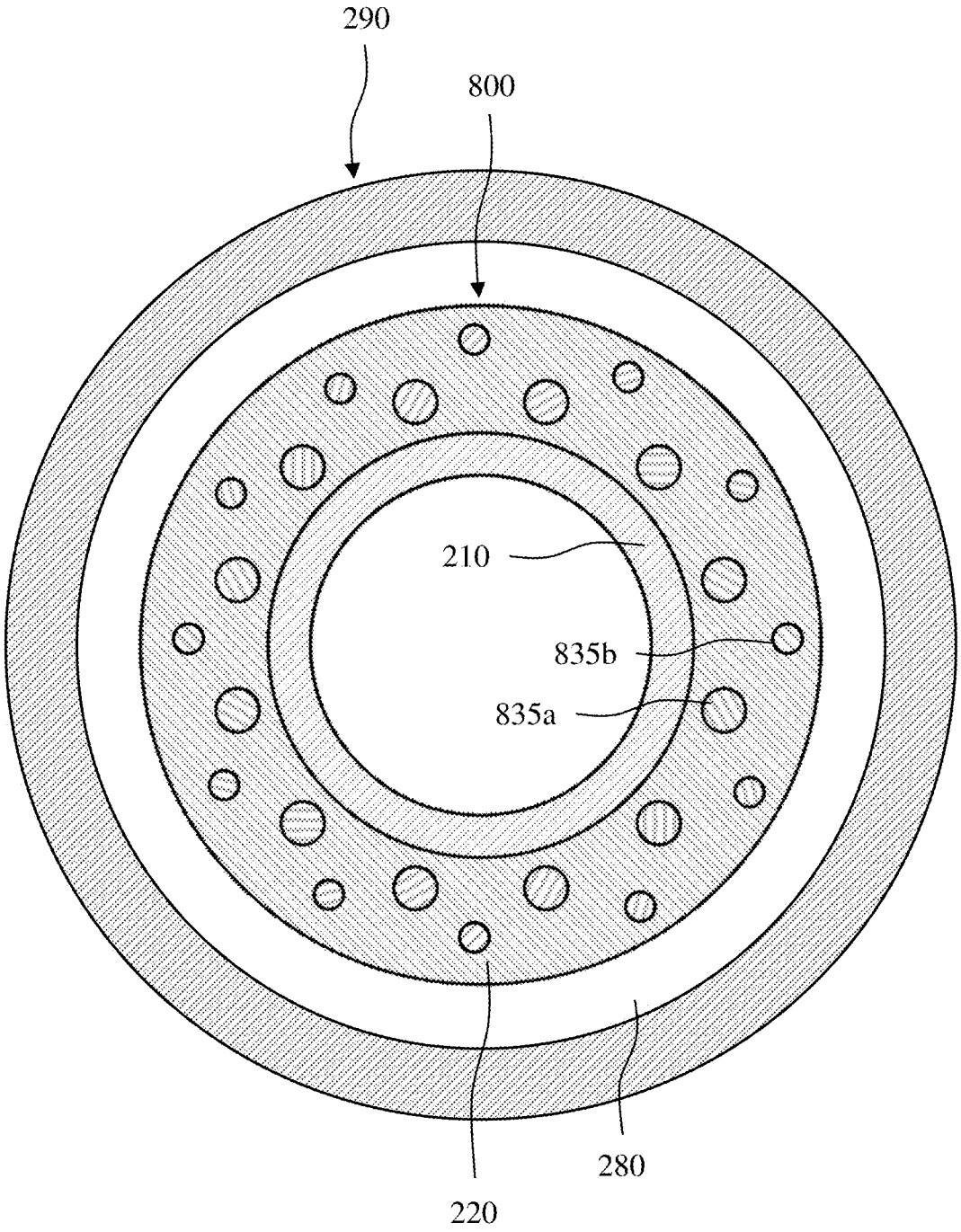
Figure 8D:
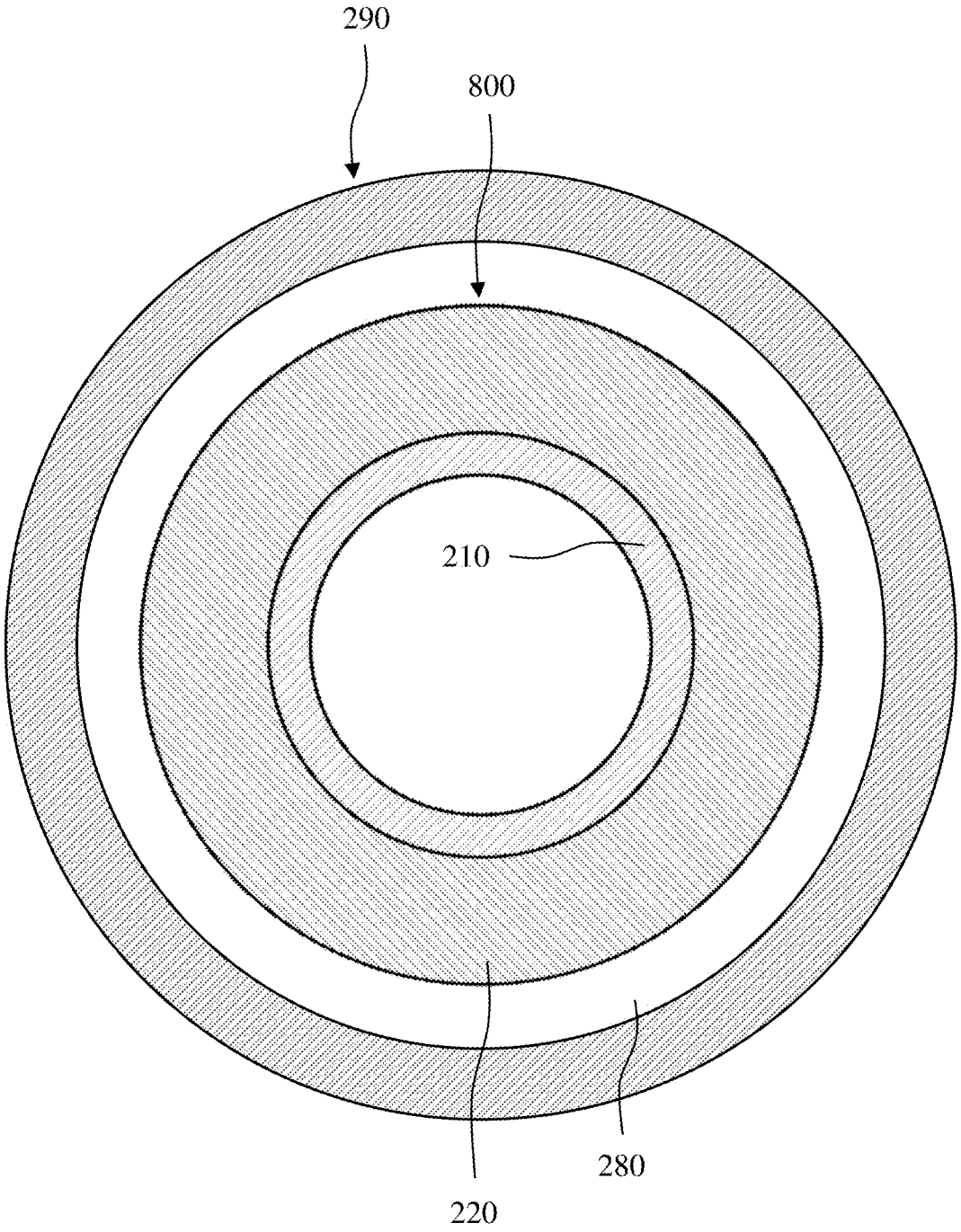
Figure 9A:
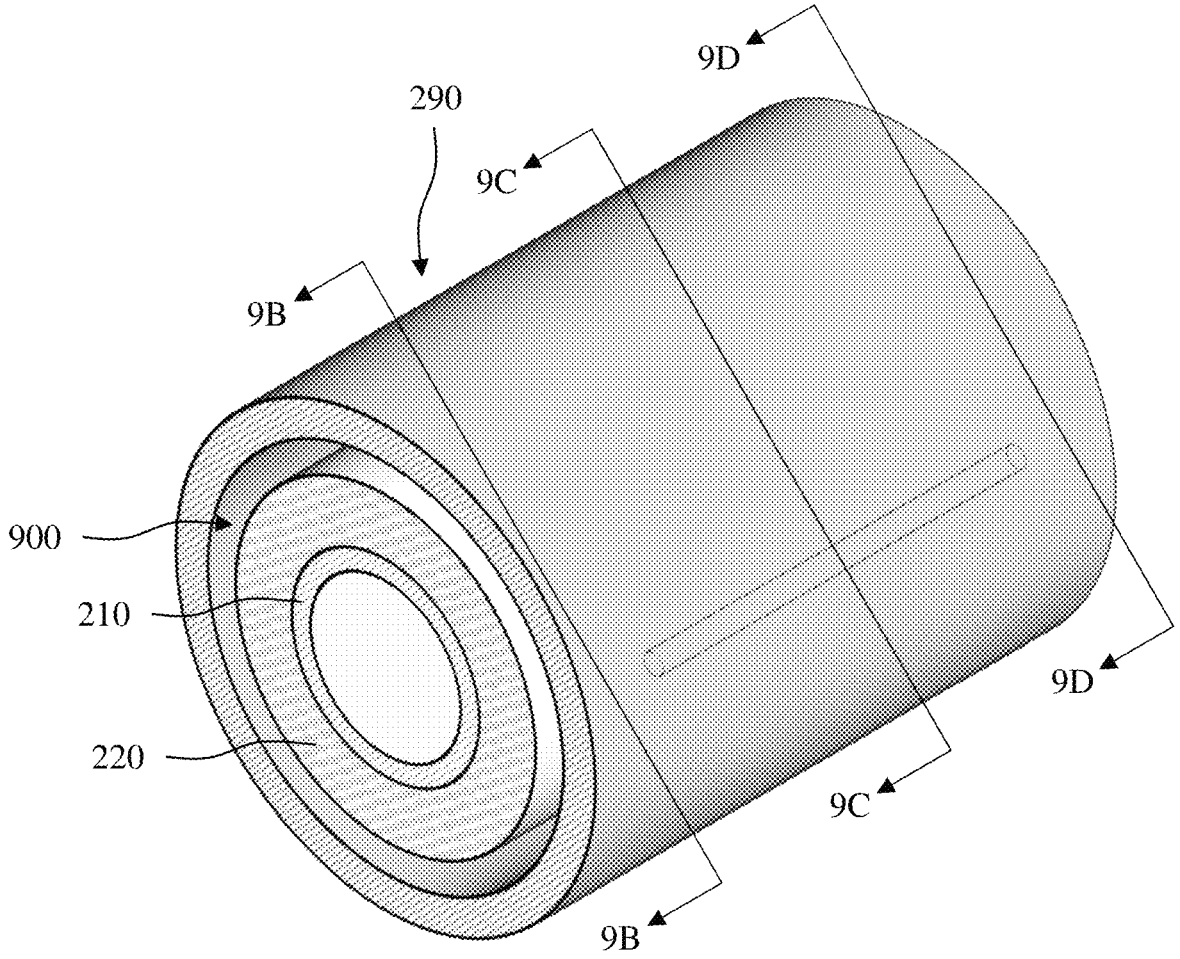
Figure 9B:
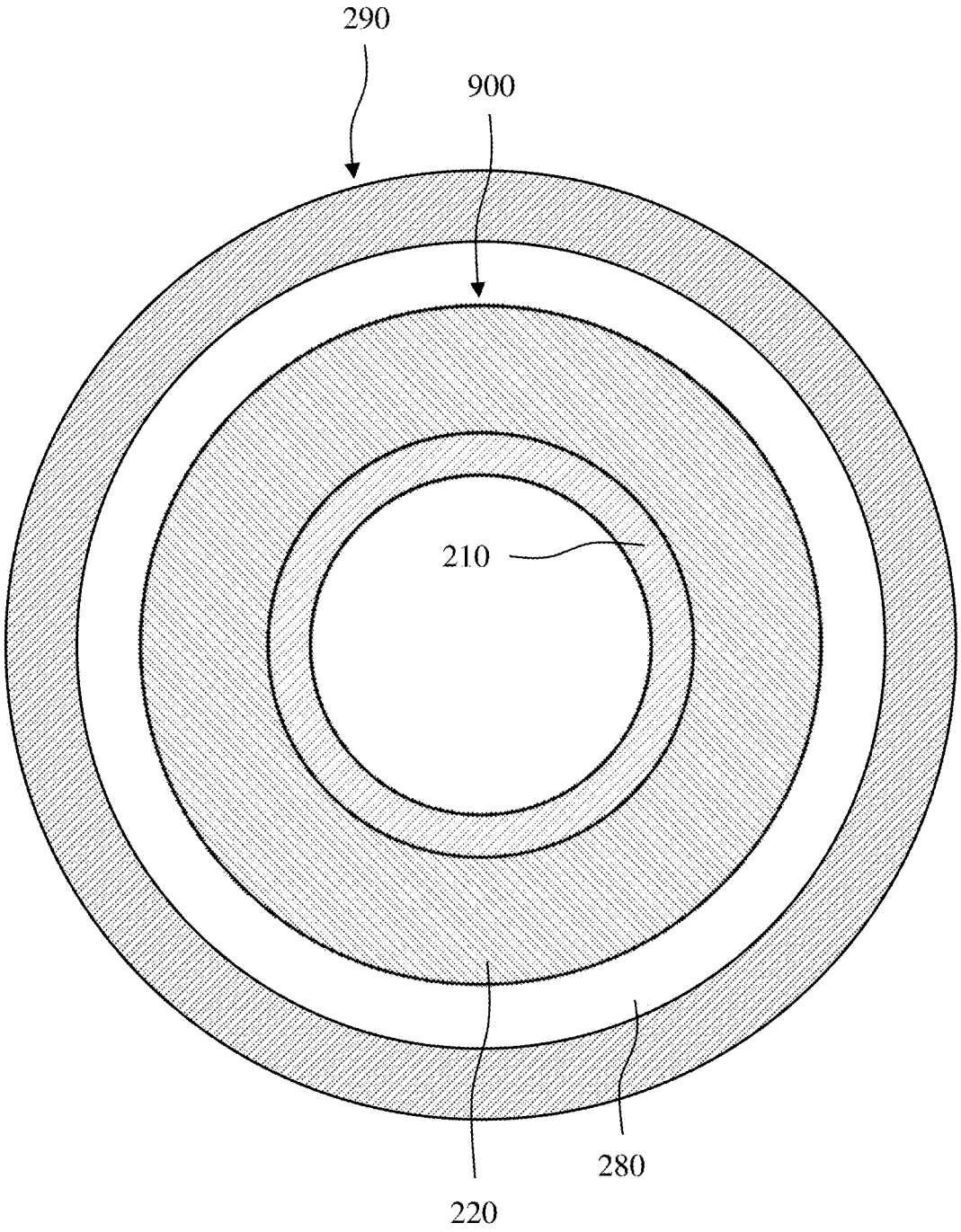
Figure 9C:
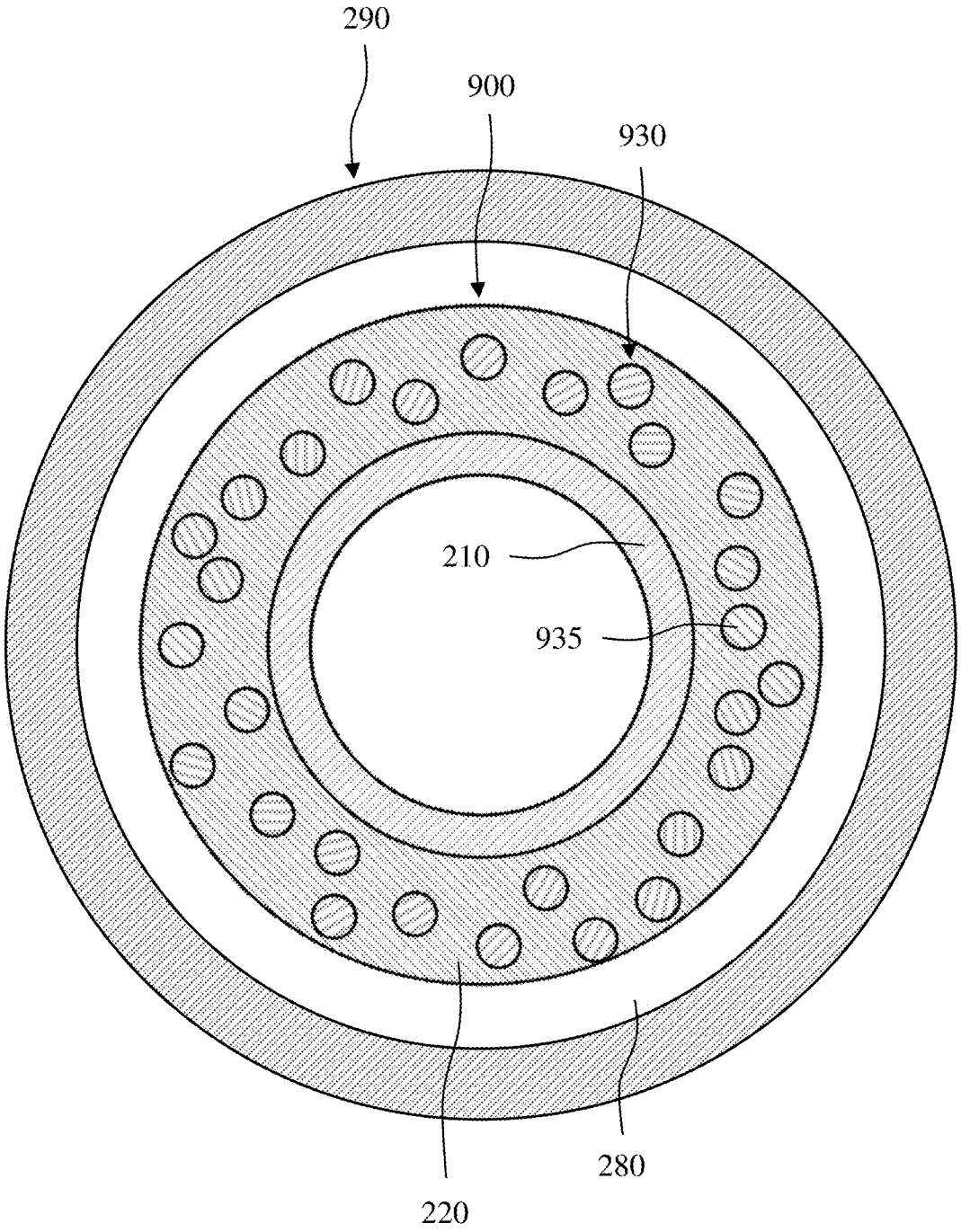
Figure 9D:
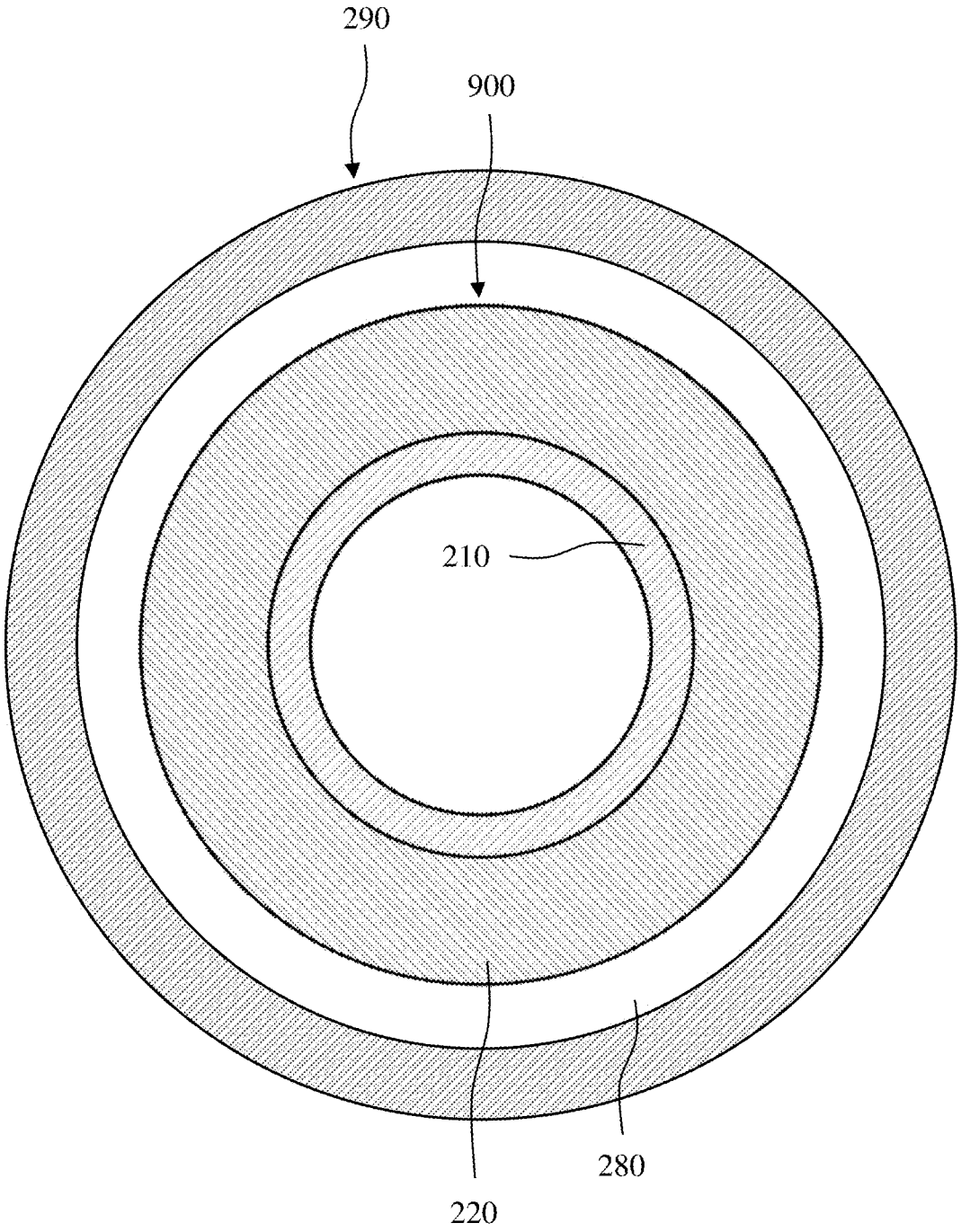
Figure 10A:
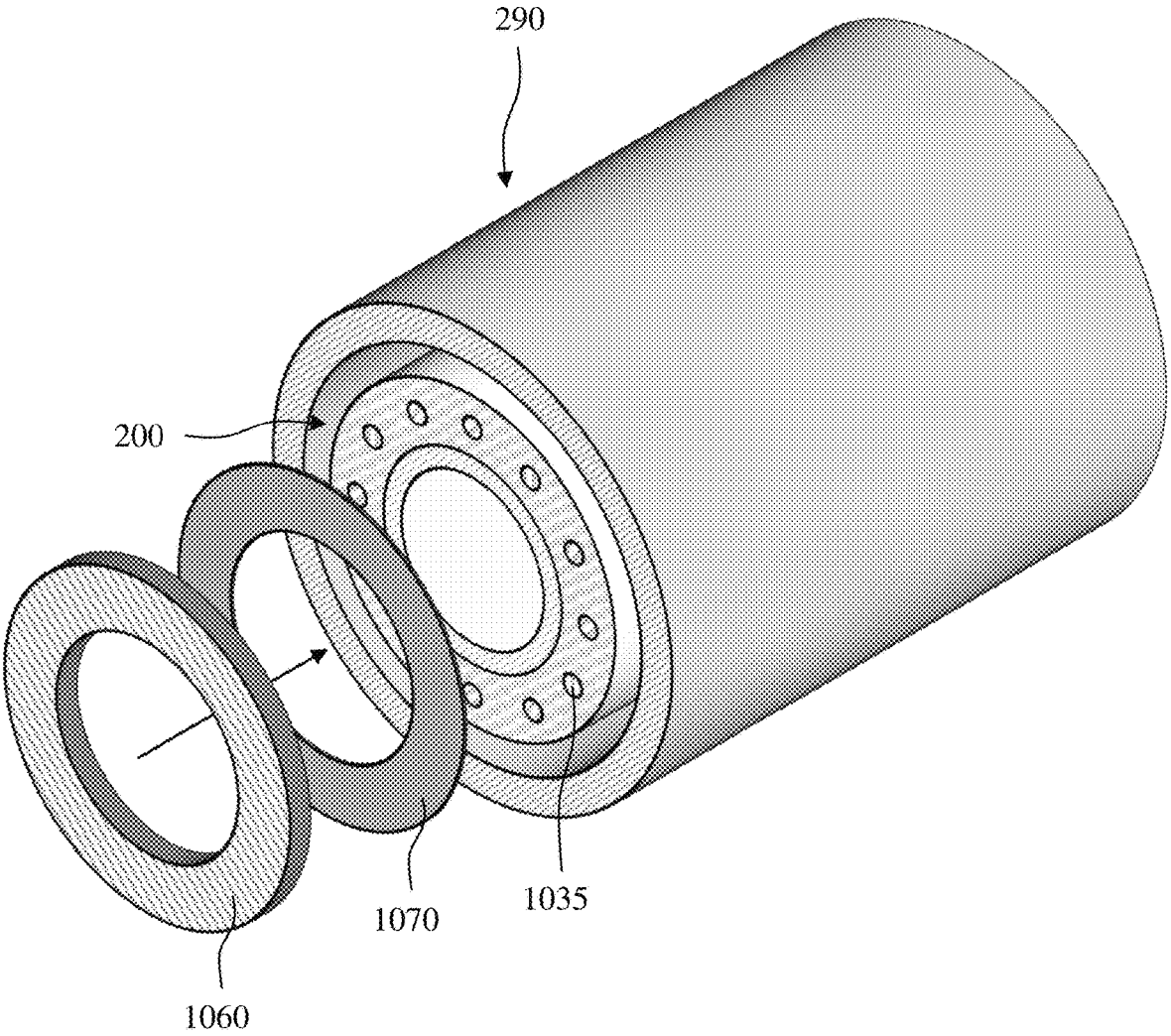
Figure 10B:
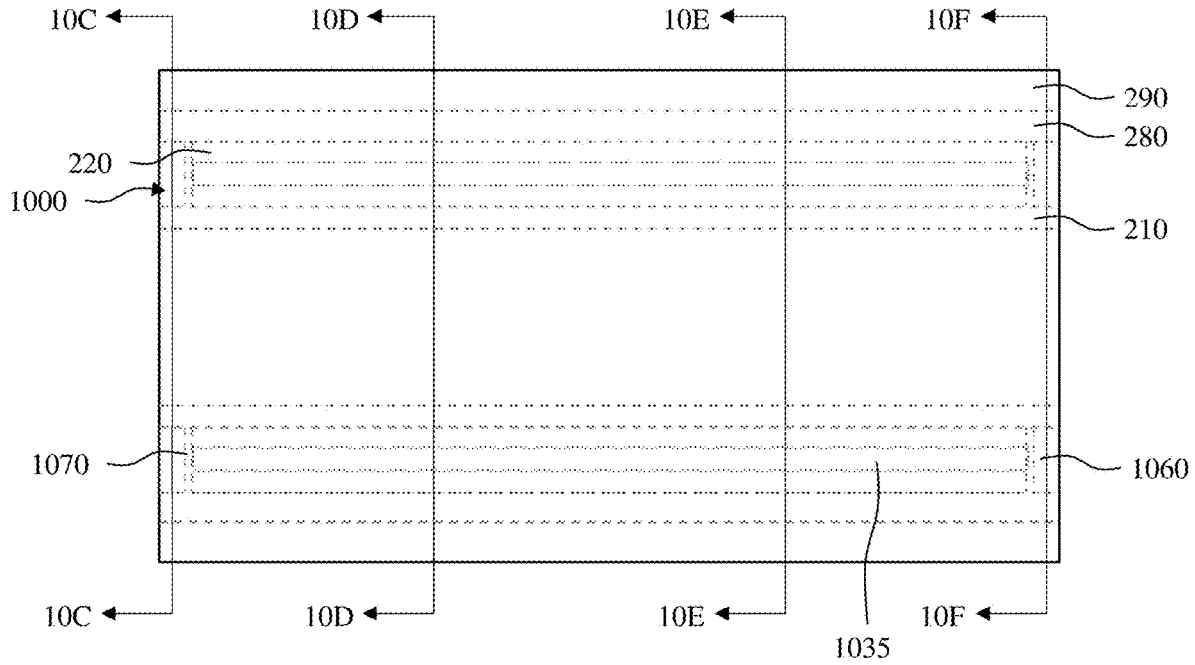
Figure 10C:
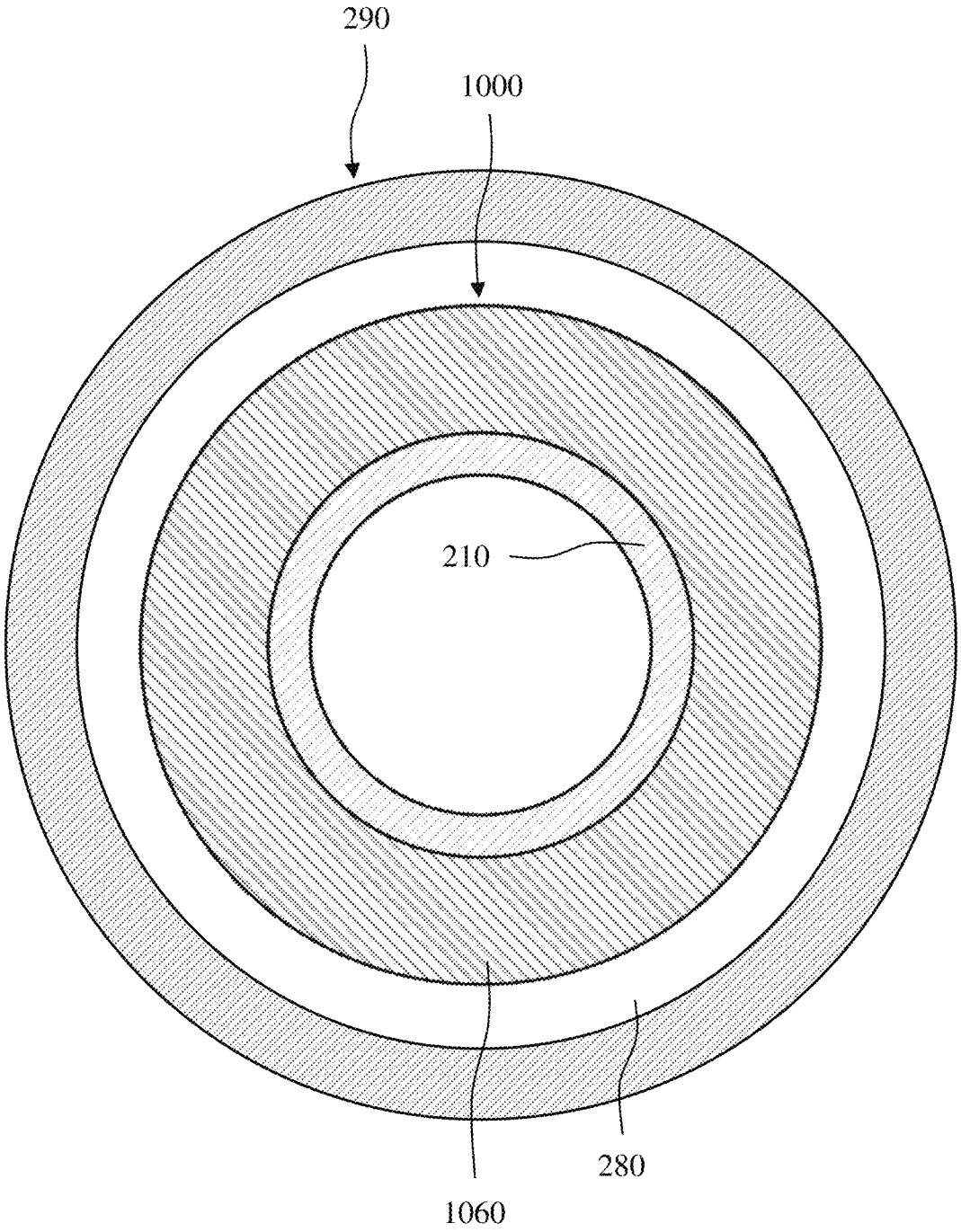
Figure 10D:
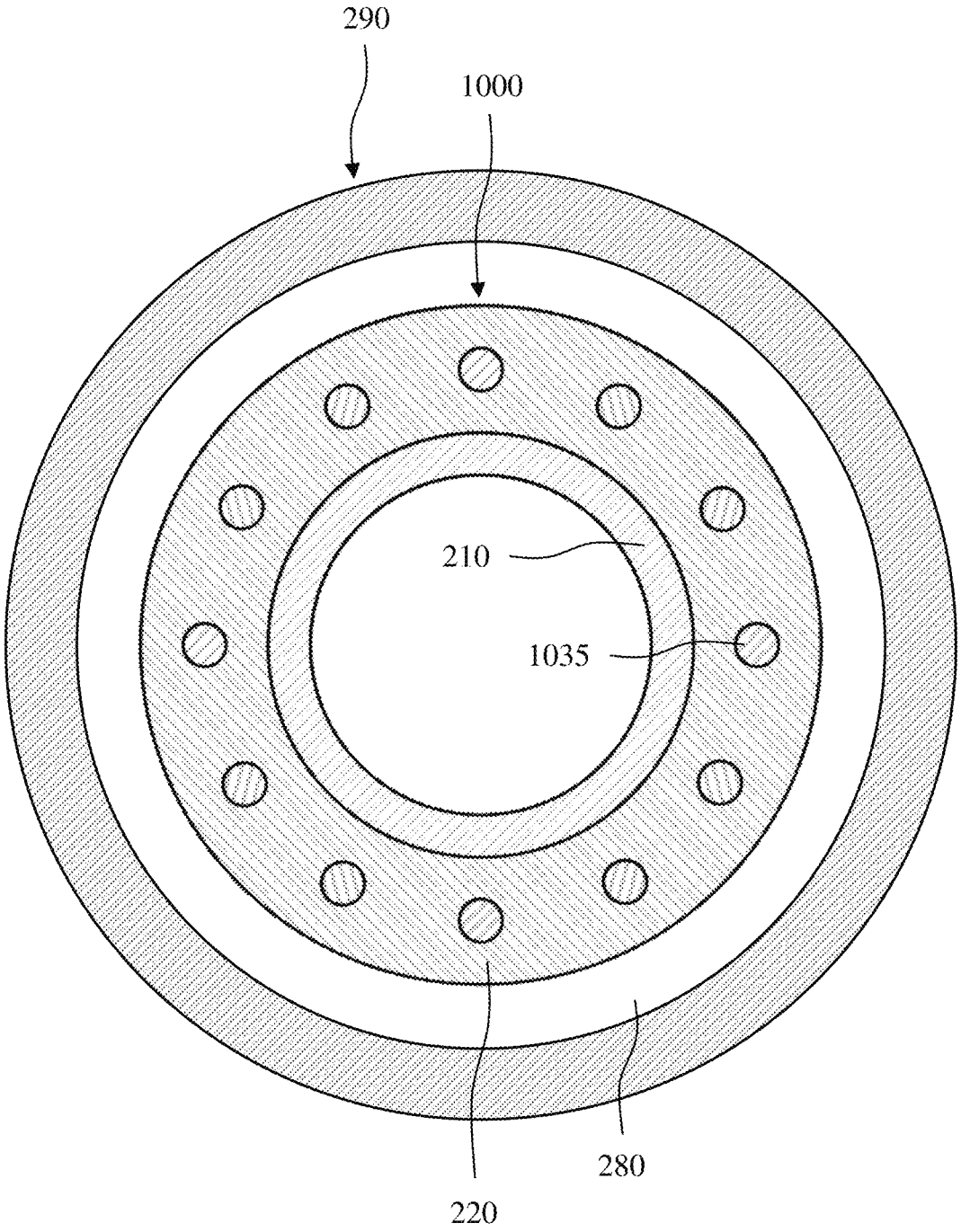
Figure 10E:
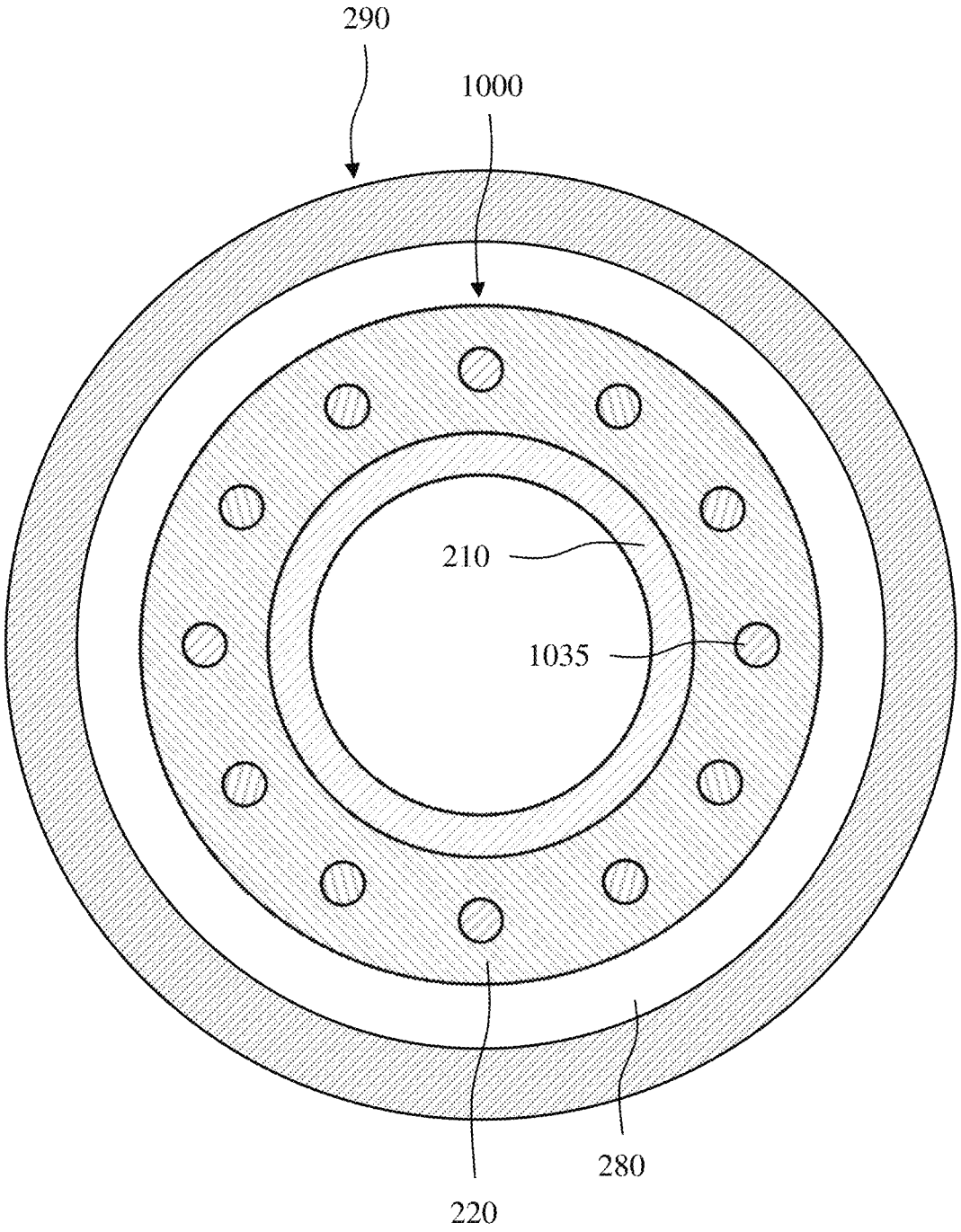
Figure 10F:
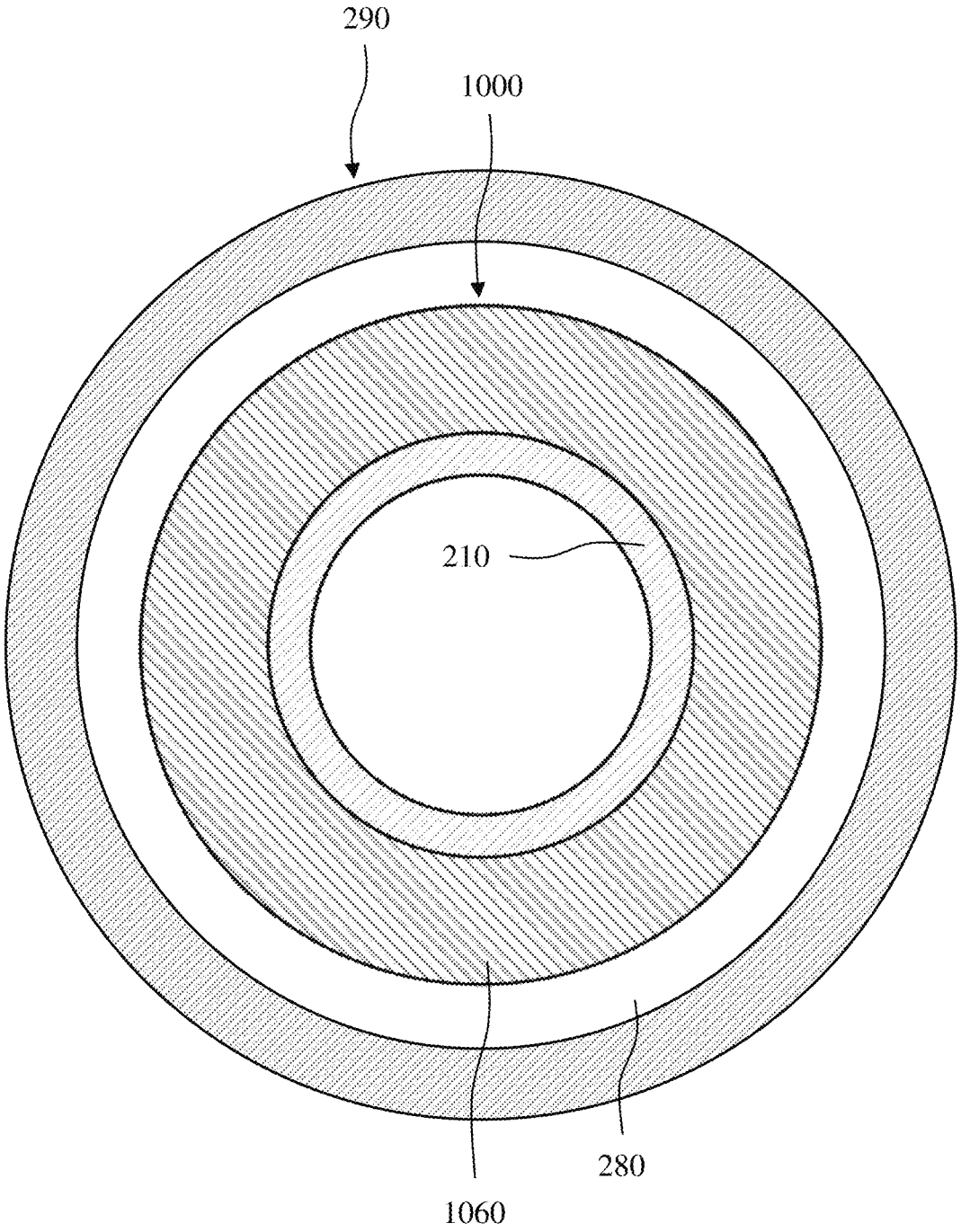

FIGS. 9A through 9D illustrate a perspective view and a plurality of enlarged cross-sectional views of a downhole tool designed, manufactured and/or operated according to one or more alternative embodiments of the disclosure; and FIGS. 10A through 10F illustrate a perspective view and a plurality of enlarged cross-sectional views of a downhole tool designed, manufactured and/or operated according to one or more alternative embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure is based, at least in part, on the acknowledgment that the use of expandable metal in wellbore applications may be problematic under certain circumstances. For example, the expandable metal may lose a percentage (e.g., a minimal percentage to a substantial percentage) of its mass when being run in hole and/or when oil-based mud is replaced with water-based mud or other reactive fluids. In certain instances, this loss in mass may cause a reduction in the achievable maximum expansion ratio, and thus diminish the final mechanical properties of the downhole tool that the expandable metal forms a part of. One solution to this problem is to employ an extremely slow reacting expandable metal, which in turn reduces the undesirable mass loss described above. However, such slow reacting expandable metals have extremely long setting durations, which is undesirable as well.

With the foregoing acknowledgments in mind, the present disclosure has recognized that by including (e.g., immersing/embedding/isolating) a dissimilar cathodic material within the otherwise slower reacting expandable metal, the expansion rate of the slower reacting expandable metal may be kept to a minimum until the reactive fluid reaches the dissimilar cathodic material, upon which it then greatly increases. The process by which this occurs is called galvanic corrosion. For example, dissimilar conductors (e.g., metals) and alloys have different electrode potentials, and when two or more conductors come into contact via an electrolyte (e.g., reactive fluid), one conductor (e.g., the one that is more reactive) acts as the anode and the other conductor (e.g., the one that is less reactive) acts as the cathode. The electropotential difference between the reactions at the two electrodes (e.g., the anode and cathode) is the driving force for an accelerated attack on the anode conductor, which dissolves/reacts with the electrolyte (e.g., reactive fluid). This leads to the anode conductor corroding/expanding more quickly than it otherwise would and corrosion of the cathode conductor being inhibited. The presence of an electrolyte (e.g., reactive fluid) and an electrical conducting path between the conductors is essential for this galvanic corrosion to occur.

In accordance with the aforementioned recognition, the present disclosure proposes employing the expandable metal as the anode, and a dissimilar cathodic electric conductor as the cathode, to achieve this galvanic corrosion effect.

Accordingly, by including (e.g., immersing/embedding/isolating) the interior dissimilar cathodic electric conductor (e.g., cathodic metal rods, wires, chunks, etc.) within the expandable metal, slower expansion of the expandable metal will be achieved for a period of time, and thus the mass loss at the fluid swap phase will be kept to a minimum. Nevertheless, as the expandable metal slowly expands and the dissimilar cathodic electric conductor is finally exposed to the electrolyte (e.g., reactive fluid), rapid expansion of the expandable metal will begin as a result of the galvanic corrosion effect.

In certain embodiments, the increase in expansion rate is a linear increase, but in other embodiments the increase is an exponential increase. In at least one embodiment, the expansion rate of the expandable metal with the galvanic corrosion effect is at least 105 percent of the expansion rate without the galvanic corrosion effect. In yet another embodiment, the expansion rate of the expandable metal with the galvanic corrosion effect is at least 125 percent of the expansion rate without the galvanic corrosion effect. In even yet another embodiment, the expansion rate of the expandable metal with the galvanic corrosion effect is at least 150 percent of the expansion rate without the galvanic corrosion effect. In even other embodiments, the expansion rate of the expandable metal with the galvanic corrosion effect is at least 200 percent, if not at least 300 percent, if not at least 500 percent, of the expansion rate without the galvanic corrosion effect. Those skilled in the art understand that there is a limit to the increase in expansion rate using the galvanic corrosion effect, which in one embodiment may be no more than 500,000 percent.

Additionally, the rate of increase of the expansion rate may be tailored based upon the desires of the user. For example, the rate of increase of the expansion rate may be adjusted upward by increasing the relative surface area (e.g., exposed surface area) of the dissimilar cathodic electric conductor in contact with the electrolyte (e.g., reactive fluid), as compared to the expandable metal in contact with the electrolyte (e.g., reactive fluid). Similarly, the rate of increase of the expansion rate may be adjusted downward by decreasing the relative surface area (e.g., exposed surface area) of the dissimilar cathodic electric conductor in contact with the electrolyte (e.g., reactive fluid), as compared to the expandable metal in contact with the electrolyte (e.g., reactive fluid). Such surface areas may be adjusted upward and downward based upon the number, amount, and location of the dissimilar cathodic electric conductor within the expandable metal. For example, when dissimilar cathodic electric conductor rods and/or wires are used, the number and/or size of the dissimilar cathodic electric conductor rods and/or wires may be increased and/or decreased to achieve a desired rate of increase of the expansion rate. Similarly, when dissimilar cathodic electric conductor chunks are used, the number and/or size of the dissimilar cathodic electric conductor chunks may be increased and/or decreased to achieve a desired rate of increase of the expansion rate.

The timing for the increase in expansion rate may also be tailored based upon the desires of the user. For example, the timing for the increase of the expansion rate may be sped up by placing the dissimilar cathodic electric conductor closer to the surface of the expandable metal. Thus, less of the expandable metal would be required to react prior to the dissimilar cathodic electric conductor coming into contact with the electrolyte (e.g., reactive fluid). In contrast, the timing for the increase of the expansion rate may be slowed down by placing the dissimilar cathodic electric conductor further away from the surface of the expandable metal. Thus, more of the expandable metal would be required to react prior to the dissimilar cathodic electric conductor coming into contact with the electrolyte (e.g., reactive fluid). Delay coatings may also be used to slow the process.

Referring to FIG. 1, depicted is a perspective view of a well system 100 including an exemplary operating environment that the apparatuses, systems and methods disclosed herein may be employed. For example, the well system 100 could use an expandable metal wellbore anchor according to any of the embodiments, aspects, applications, variations, designs, etc. disclosed in the following paragraphs. The well system 100 illustrated in FIG. 1 includes a drilling rig 110 extending over and around a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, work string, or any other suitable means for conveying the downhole tool assembly 180 into the wellbore 120. In one particular advantageous embodiment, the downhole conveyance 170 is American Petroleum Institute "API" pipe.

The downhole tool assembly 180, may comprise many different downhole tools employing expandable metal and remain within the scope of the disclosure. In the illustrated embodiment, however, the downhole tool assembly 180 includes a downhole tool 185 and an expandable metal wellbore anchor 190. The downhole tool 185 may comprise any downhole tool that could be anchored within a wellbore. Certain downhole tools that may find particular use in the well system 100 include, without limitation, sealing packers, elastomeric scaling packers, non-elastomeric sealing packers (e.g., including plastics such as PEEK, metal packers such as inflatable metal packers, as well as other related packers), liners, an entire lower completion, one or more tubing strings, one or more screens, one or more production sleeves, etc.

The expandable metal wellbore anchor 190, in accordance with at least one embodiment of the disclosure, includes one or more expandable metal members positioned on the downhole conveyance 170. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal. In at least one embodiment, the residual unreacted metal exists when the expandable metal has expanded into contact with another feature, such as another wellbore tubular, prior to all of the expanded metal reacting into expanded metal. Once the expanded metal has sealed against this wellbore tubular, the reactive fluid may no longer reach the expandable metal, and the hydrolysis essentially ends. Similarly, if all of the expandable metal has reacted into expanded metal prior to sealing against the wellbore tubular, the expanded metal may ultimately wash away.

The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, surface-area-to-volume ratio (SA:V) of the expandable metal, and any dissimilar cathodic electric conductors that may be included therein (e.g., as discussed herein).

In some embodiments, the reactive fluid may be a brine solution such as may be produced during well completion activities, and in other embodiments, the reactive fluid may be one of the additional solutions discussed herein (e.g., water-based mud). The expandable metal is electrically conductive in certain embodiments. The expandable metal, in certain embodiments, has a yield strength greater than about 8,000 psi, e.g., 8,000 psi+/−50%. The expandable metal, in at least one embodiment, has a minimum dimension greater than about 1.25 mm (e.g., approximately 0.05 inches).

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

It should be noted that the starting expandable metal, unless otherwise indicated, is not a metal oxide (e.g., an insulator). In contrast, the starting expandable metal has, in certain embodiments, the properties of traditional metals: 1) Highly conductive to both electricity and heat (e.g., greater than 1,000,000 siemens per meter); 2) Contains a metallic bond (e.g., the outermost electron shell of each of the metal atoms overlaps with a large number of neighboring atoms). As a consequence, the valence electrons are allowed to move from one atom to another and are not associated with any specific pair of atoms. This gives metals their conductive nature; 3) Malleable and ductile, for example deforming under stress without cleaving; and 4) Tend to be shiny and lustrous with high density.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow AlO(OH)+3/2H_2$$

$$Al+3/2H_2O \rightarrow 1/2Al_2O_3+3/2H_2$$

Another hydration reaction uses calcium hydrolysis. The hydration reaction for calcium is:

$$Ca+2H_2O \rightarrow Ca(OH)_2+H_2.$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it means that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_{3D}lO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for supporting the necessary features. For example, the expandable metal may be formed into a single long member, multiple short members, rings, among others. In another embodiment, the expandable metal may be formed into a long wire of expandable metal, which can be in turn be wound around a mandrel as a sleeve. The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques, including an enclosure (e.g., an enclosure that could be crushed to expose the individual separate chunks to the reactive fluid), a cage, etc.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. The delay coating or protective layer may be applied to any of the different expandable metal configurations disclosed above.

In accordance with one embodiment of the disclosure, a dissimilar cathodic electric conductor may be included within the expandable metal. The phrase "included within," as used with regard to the dissimilar cathodic electric conductors and the expandable metal, means that the dissimilar cathodic electric conductor is at least initially shielded from the electrolyte (e.g., reactive fluid). In at least one embodiment, the dissimilar cathodic electric conductor is at least initially fully embedded within the expandable metal, such that the expandable metal fully surrounds all elements of the dissimilar cathodic electric conductor. In yet another embodiment, the dissimilar cathodic electric conductor is at least initially not fully embedded within the expandable metal, but another feature shields those portions of the dissimilar cathodic electric conductor not surrounded by the expandable metal from the electrolyte (e.g., reactive fluid). In at least one embodiment, this could be one or more different types of delay coatings. In yet another embodiment, this could be a pair of end rings (e.g., including one or more insulating material layers) that seal off any exposed ends of the dissimilar cathodic electric conductor. Again, it is important that the dissimilar cathodic electric conductor be fully shielded from the electrolyte (e.g., reactive fluid) for a desired period of time, or else the galvanic corrosion effect will prematurely increase the rate of expansion of the expandable metal.

Turning to FIGS. 2A through 2D, illustrated is a perspective view and a plurality of enlarged cross-sectional views of a downhole tool 200 designed, manufactured and/or operated according to one or more embodiments of the disclosure. FIGS. 2A through 2D illustrated one embodiment of the downhole tool in its the run-in-hole state (e.g., original state). In the illustrated embodiment, the downhole tool 200 is positioned within a conduit 290. The term conduit, as used herein, is intended to mean any structure of tubular nature. In at least one embodiment, the conduit 290 is an open-hole wellbore. In yet another embodiment, the conduit 290 is wellbore casing or wellbore cement located within a wellbore. In even yet another embodiment, the conduit 290 is another tubular and or feature located within a wellbore. Accordingly, unless otherwise stated, the term conduit 290 should not be limited to any specific type and/or use of a feature within a wellbore.

The downhole tool 200, in the embodiments of FIGS. 2A through 2D, initially includes a structure 210. The structure 210, in at least one embodiment (e.g., as shown), is a tubular. Other embodiments exist, however, wherein the structure 210 is a solid rod (e.g., regardless of cross section), housing, and/or any other feature of a downhole tool. While it is envisioned that the structure 210 is a metal structure in one embodiment, the present disclosure is not so limited, and thus the structure 210 may comprise any material.

The downhole tool 200, in the embodiments of FIGS. 2A through 2D, additionally includes an expandable metal member 220 positioned about the structure 210. In accordance with the disclosure, the expandable metal member 220 comprises a metal configured to expand in response to hydrolysis, and may include any of the expandable metals disclosed herein. In the illustrated embodiment, the expandable metal member 220 is an expandable metal tubular having a sidewall thickness (t). The sidewall thickness (t), in one or more embodiments, may vary greatly based upon the expansion ratio that the expandable metal member 220 is desired to achieve. For example, the sidewall thickness (t) should be enough to allow the expandable metal member 200 to expand into contact with the conduit 290 (e.g., spanning the space 280 between the conduit 290 and the expandable metal member 220) prior to all of the expandable metal member 220 undergoing hydrolysis.

The downhole tool 200, in accordance with one embodiment of the disclosure, additionally includes a dissimilar cathodic electric conductor 230 isolated within the expandable metal member 220. In at least one embodiment, the dissimilar cathodic electric conductor 230 is configured to initiate a galvanic corrosion effect to increase an expansion rate of the expandable metal member 220 when a reactive fluid comes into contact with the dissimilar cathodic electric conductor 230 and the expandable metal member 220. In the embodiment of FIGS. 2A through 2D, however, the dissimilar cathodic electric conductor 230 is isolated within the expandable metal member 220, thus the galvanic corrosion effect may not begin.

In the embodiment of FIGS. 2A through 2D, the dissimilar cathodic electric conductor 230 is a plurality of dissimilar cathodic electric conductor wires 235 located (e.g., longitudinally placed) within the sidewall thickness (t) of the expandable metal member 220. The term "wire," as used herein, is intended to include both ductile wires and rigid wires (e.g., also referred to as rods), as well as may be tubular in nature and/or solid in nature. Similarly, the plurality of dissimilar cathodic electric conductor wires 235 may have any cross-sectional shape, in addition to the circular shape illustrated. In the embodiment of FIGS. 2A through 2D, the plurality of dissimilar cathodic electric conductor wires 235 have a length (l) and a longest cross-sectional dimension (d). In at least one embodiment, the length (l) is at least 2 times greater than the longest cross-sectional dimension (d). In at least one other embodiment, the length (l) is at least 3 times greater than the longest cross-sectional dimension (d), if not at least 10 times greater.

Further to the embodiment of FIGS. 2A through 2D, the plurality of dissimilar cathodic electric conductor wires 235 may be positioned at a consistent radial distance about the sidewall thickness (t), as shown by the dotted line 238. In yet another embodiment, the plurality of dissimilar metal wires 235 are spaced equidistance within the sidewall thickness (t). Accordingly, at least in this embodiment, no single cathodic metal wire 235 is closer to one adjacent cathodic metal wire 235 than another adjacent cathodic metal wire 235. In even yet another embodiment (not shown), each of the cathodic metal wires 235 may be broken into multiple linearly aligned but slightly separated metal wire pieces.

As shown in the various cross-sections of the downhole tool 200, the plurality of cathodic metal wires 235 are fully embedded within the expandable metal member 220 in the embodiment of FIGS. 2A through 2D. Thus, in accordance with this embodiment, the length (l) is less than a length of the expandable metal member 220. Therefore, in at least this embodiment, the plurality of cathodic metal wires 235 are not exposed at one or more of the sidewalls of the expandable metal member 220.

Again, as discussed above, the expandable metal member 220 should function as the anode and the dissimilar cathodic electric conductor 230 should function as the cathode in the galvanic corrosion effect. Accordingly, the material comprising the expandable metal member 200 should be more corrosive (e.g., have a greater corrosive potential) than the material comprising the dissimilar cathodic electric conductor (e.g., have a lesser corrosive potential), or else the opposite would hold true. In at least one embodiment, the expandable metal member 220 is a magnesium containing expandable metal member 220. In this embodiment, as magnesium has a very high corrosive potential, most any other conductors may be used for the dissimilar cathodic electric conductor. Some examples of dissimilar cathodic electric conductors include, but are not limited to, metals such as zinc, copper, aluminum, low alloy steel, any grade of stainless steel, titanium and/or any combinations/alloys of these metals. In addition to metals, conductive non-metals such as graphite can also be used as the dissimilar cathodic electric conductors (e.g., cathode).

The embodiment of FIGS. 2A through 2D illustrate and discuss the dissimilar cathodic electric conductor 230 as a plurality of dissimilar cathodic electric conductor wires 235. Notwithstanding, the present disclosure is not so limited. In yet other embodiments, the dissimilar cathodic electric conductor 230 could be a plurality of dissimilar cathodic electric conductor ball bearings, or screws, or collection of electrically conductive woven materials, among others.

Turning now to FIGS. 3A through 3D, illustrated are the downhole tool 200 and conduit 290 of FIGS. 2A through 2D, after the expandable metal member 220 has first come into contact with the reactive fluid. As shown, at least a portion of the expandable metal member 200 has expanded in response to hydrolysis to form a small expanded metal ring 240. In the embodiment of FIGS. 3A through 3D, the dissimilar cathodic electric conductor 230 remains isolated within the expandable metal member 220, and thus the reactive fluid still cannot contact the dissimilar cathodic electric conductor 230. Accordingly, the galvanic corrosion effect has yet to begin, and thus the expandable metal member 200 is expanding at the slower expansion rate. Thus, the expandable metal member 220 is expanding at a first rate while the dissimilar cathodic electric conductor 230 is isolated from the reactive fluid.

Turning now to FIGS. 4A through 4D, illustrated are the downhole tool 200 and conduit 290 of FIGS. 3A through 3D, as more of the expandable metal member 200 has expanded in response to hydrolysis to form a larger expanded metal ring 250. At this stage, the expandable metal member 220 has expanded (e.g., radially expanded) enough to allow the dissimilar cathodic electric conductor 230 to come into contact with the reactive fluid. Accordingly, the galvanic corrosion effect has just been initiated, the galvanic corrosion effect causing the expansion of the expandable metal member 220 to increase from the first rate to a second greater rate. Thus, the expandable metal member 200 is now expanding at an increased (e.g., rapid) expansion rate.

Turning now to FIGS. 5A through 5D, illustrated are the downhole tool 200 and conduit 290 of FIGS. 4A through 4D, as the expandable metal member 200 has further expanded in response to hydrolysis to form an expanded metal feature 260 (e.g., expanded metal plug). At this stage, the expandable metal member 200, to the extent it has any additional expandable metal, can no longer expand, and thus the hydrolysis ends for the most part. As will be discussed below, the expandable metal member 200 may, in certain embodiments, include residual unreacted metal. The residual unreacted metal has the benefit of allowing the expanded metal feature 260 to self-heal if cracks or other anomalies subsequently arise, or for example to accommodate changes in the tubular or mandrel diameter due to variations in temperature and/or pressure, among other things.

While the embodiment of FIGS. 2A through 5D illustrates the dissimilar cathodic electric conductor 230 as plurality of straight longitudinal rods immersed into the expandable metal member 220 with equal distances there between, many other alternative configurations are possible. Some alternative embodiments can incorporate different number of dissimilar cathodic electric conductors, multiple types of dissimilar cathodic electric conductors, multiple layers of dissimilar cathodic electric conductors, dissimilar cathodic electric conductors at an angled orientation, varying cross-sectional areas for the dissimilar cathodic electric conductors, different distances between the dissimilar cathodic electric conductors, different distance between the OD/ID of the expandable metal member 220 and the dissimilar cathodic electric conductors, different diameters for dissimilar cathodic electric conductors, any other shape other than circular rods for dissimilar cathodic electric conductors, discontinuous dissimilar cathodic electric conductors, dissimilar cathodic electric conductors with a different length than the expandable metal member 220, etc. Basically, any configuration can be possible as long as a successful a galvanic corrosion effect with desired corrosion rate is obtained. These parameters can be decided on a case-by-case basis.

Turning now to FIGS. 6A through 6D, illustrated is a perspective view and a plurality of enlarged cross-sectional views of a downhole tool 600 designed, manufactured and/or operated according to one or more alternative embodiments of the disclosure after at least partially completing a setting phase. The downhole tool 600 of FIGS. 6A through 6D is similar in many respects to the downhole tool 200 of FIGS. 5A through 5D. Accordingly, like reference numbers have been used to indicate similar, if not identical, features. The downhole tool 600 of FIGS. 6A through 6D differs, for the most part, from the downhole tool 200 of FIGS. 5A through 5D, in that the downhole tool 600 includes an expanded metal feature 660 that includes residual unreacted metal. As indicated above, the residual unreacted metal has the benefit of allowing the expanded metal feature 660 to self-heal if cracks or other anomalies subsequently arise, or for example to accommodate changes in the tubular or mandrel diameter due to variations in temperature and/or pressure, among other things.

Turning now to FIGS. 7A through 7D, illustrated is a perspective view and a plurality of enlarged cross-sectional views of a downhole tool 700 designed, manufactured and/or operated according to one or more alternative embodiments of the disclosure. The downhole tool 700 of FIGS. 7A through 7D is similar in many respects to the downhole tool 200 of FIGS. 2A through 2D. Accordingly, like reference numbers have been used to indicate similar, if not identical, features. The downhole tool 700 of FIGS. 7A through 7D differs, for the most part, from the downhole tool 200 of FIGS. 2A through 2D, in that the dissimilar cathodic electric conductor 730 of the downhole tool 700 includes a first plurality of dissimilar cathodic electric conductor wires 735*a* positioned at a first inner radial distance 738*a* (e.g., first consistent inner radial distance) within the sidewall thickness (t) of the expandable metal member 220, and further includes a second plurality of dissimilar cathodic electric conductor wires 735*b* positioned at a second outer radial distance 738*b* (e.g., second consistent outer radial distance) within the sidewall thickness (t) of the expandable metal member 220.

In accordance with one embodiment, the first and second plurality of dissimilar cathodic wires 735*a*, 735*b* are radially staggered, such that the second plurality of dissimilar cathodic wires 735*b* will encounter the reactive fluid prior to the first plurality of dissimilar cathodic wires 735*a*. In at least one embodiment, the first and second plurality of dissimilar cathodic wires 735*a*, 735*b* overlap, such that at least one of them is consistently in contact with the reactive fluid once the galvanic corrosion effect begins and until the space 280 is fully filled. In at least one other embodiment, the first and second plurality of dissimilar cathodic wires 735*a*, 735*b* do not overlap.

Turning now to FIGS. 8A through 8D, illustrated is a perspective view and a plurality of enlarged cross-sectional views of a downhole tool 800 designed, manufactured and/or operated according to one or more alternative embodiments of the disclosure. The downhole tool 800 of FIGS. 8A through 8D is similar in many respects to the downhole tool 700 of FIGS. 7A through 7D. Accordingly, like reference numbers have been used to indicate similar, if not identical, features. The downhole tool 800 of FIGS. 8A through 8D differs, for the most part, from the downhole tool 700 of FIGS. 7A through 7D, in that its first plurality of dissimilar cathodic electric conductor wires 835*a* and its second plurality of dissimilar cathodic electric conductor wires 835*b* have different cross-sectional areas. For example, in the embodiment shown, a cross-sectional area of the first plurality of dissimilar cathodic electric conductor wires 835*a* is greater than a cross-sectional area of the second plurality of dissimilar cathodic electric conductor wires 835*b*. In this embodiment, the rate of expansion would increase as the reactive fluid reaches the second plurality of dissimilar cathodic electric conductor wires 835*b*, and would further increase when the reactive fluid reaches the first plurality of dissimilar cathodic electric conductor wires 835*a*. In certain other embodiments, however, the cross-sectional area of the first plurality of dissimilar cathodic electric conductor wires 835*a* is less than the cross-sectional area of the second plurality of dissimilar cathodic electric conductor wires 835*b*.

Turning now to FIGS. 9A through 9D, illustrated is a perspective view and a plurality of enlarged cross-sectional views of a downhole tool 900 designed, manufactured and/or operated according to one or more alternative embodiments of the disclosure. The downhole tool 900 of FIGS. 9A through 9D is similar in many respects to the downhole tool 200 of FIGS. 2A through 2D. Accordingly, like reference numbers have been used to indicate similar, if not identical, features. The downhole tool 900 of FIGS. 9A through 9D differs, for the most part, from the downhole tool 200 of FIGS. 2A through 2D, in that the dissimilar cathodic electric conductor 930 of the downhole tool 900 includes a plurality of dissimilar cathodic electric conductor wires 935 that are inconsistently positioned within the sidewall thickness (t) of the expandable metal member 220. The term "inconsistent," as used herein means that no pattern may be found, and in certain embodiments may be randomly positioned.

Turning now to FIGS. 10A through 10F, illustrated is a perspective view, a side view, and a plurality of enlarged cross-sectional views of a downhole tool 1000 designed, manufactured and/or operated according to one or more alternative embodiments of the disclosure. The downhole tool 1000 of FIGS. 10A through 10F is similar in many respects to the downhole tool 200 of FIGS. 2A through 2D. Accordingly, like reference numbers have been used to indicate similar, if not identical, features. The downhole tool 1000 of FIGS. 10A through 10F differs, for the most part, from the downhole tool 200 of FIGS. 2A through 2D, in that the dissimilar cathodic electric conductor 1030, and more particularly the plurality of dissimilar cathodic electric conductor wires 1035, are exposed at one or more sidewalls of the expandable metal member 220. Accordingly, in this embodiment, the plurality of dissimilar cathodic electric conductor wires 1035 are not fully embedded within the expandable metal member 220.

This embodiment has the added benefit of being able to easily include the plurality of dissimilar cathodic electric conductor wires 1035 within the expandable metal member 220. For example, openings for the plurality of dissimilar cathodic electric conductor wires 1035 could be formed (e.g., drilled) in the sidewall of the expandable metal member 220, and thereafter the plurality of dissimilar cathodic electric conductor wires 1035 insert therein.

However, given that the plurality of dissimilar cathodic electric conductor wires 1035 are exposed at one or more sidewalls of the expandable metal member 220 in the embodiment of FIGS. 10A through 10F, one or more end rings 1060 may be coupled with the one or more sidewalls to isolate the exposed portions of the plurality of dissimilar cathodic electric conductor wires 1035. The end rings 1060, in one or more embodiments, may comprise non-conductive end rings. In one or more other embodiments, such as shown herein, the end rings 1060 may comprise conductive (e.g., metal) end rings. In such an embodiment, an insulating material 1070 (e.g., PEEK in one embodiment) may be located between the exposed portions of the plurality of dissimilar cathodic electric conductor wires 1035 and the one or more end rings 1060.

Aspects Disclosed Herein Include:

A. A downhole tool, the downhole tool including: 1) a structure; 2) an expandable metal member positioned about the structure, the expandable metal member comprising a metal configured to expand in response to hydrolysis; and 3) a dissimilar cathodic electric conductor isolated within the expandable metal member, the dissimilar cathodic electric conductor configured to initiate a galvanic corrosion effect to increase an expansion rate of the expandable metal member when a reactive fluid comes into contact with the dissimilar cathodic electric conductor and the expandable metal member.

B. A well system, the well system including: 1) a wellbore positioned within a subterranean formation; 2) a downhole tool positioned within the wellbore, the downhole tool including: a) a structure; b) an expandable metal member positioned about the structure, the expandable metal member comprising a metal configured to expand in response to hydrolysis; and c) a dissimilar cathodic electric conductor isolated within the expandable metal member, the dissimilar cathodic electric conductor configured to initiate a galvanic corrosion effect to increase an expansion rate of the expandable metal member when a reactive fluid comes into contact with the dissimilar cathodic electric conductor and the expandable metal member.

C. A method, the method including: 1) positioning a downhole tool within a wellbore of a subterranean formation, the downhole tool including: a) a structure; b) an expandable metal member positioned about the structure, the expandable metal member comprising a metal configured to expand in response to hydrolysis; and C) a dissimilar cathodic electric conductor isolated within the expandable metal member; 2) subjecting the expandable metal member to a reactive fluid, the reactive fluid: i) causing the expandable metal member to expand at a first rate while the dissimilar cathodic electric conductor is isolated from the reactive fluid; and ii) initiating a galvanic corrosion effect between the expandable metal member and the dissimilar cathodic electric conductor when the reactive fluid comes into contact with the dissimilar cathodic electric conductor and the expandable metal member, the galvanic corrosion effect causing the expansion of the expandable metal member to increase from the first rate to a second greater rate.

Aspects A, B, and C may have one or more of the following additional elements in combination: Element 1: wherein the dissimilar cathodic electric conductor is a plurality of dissimilar cathodic electric conductor wires located within a sidewall thickness (t) of the expandable metal member. Element 2: wherein the plurality of dissimilar cathodic electric conductor wires have a length (l) and a longest cross-sectional dimension (d), and further wherein the length (l) is at least 3 times greater than the longest cross-sectional dimension (d). Element 3: wherein the plurality of dissimilar cathodic electric conductor wires are a first plurality of dissimilar cathodic electric conductor wires positioned at a first inner radial distance within the sidewall thickness (t) of the expandable metal member, and further including a second plurality of dissimilar cathodic electric conductor wires positioned at a second outer radial distance within the sidewall thickness (t) of the expandable metal member. Element 4: wherein the first plurality of dissimilar cathodic electric conductor wires are spaced equidistance with the sidewall thickness (t) of the expandable metal member at the first inner radial distance, and the second plurality of dissimilar cathodic electric conductor wires are spaced equidistance with the sidewall thickness (t) of the expandable metal member at the second outer radial distance. Element 5: wherein the first plurality of dissimilar cathodic electric conductor wires and the second plurality of dissimilar cathodic electric conductor wires have different cross-sectional areas. Element 6: wherein the plurality of dissimilar cathodic electric conductor wires are positioned at a radial distance about and spaced equidistance within the sidewall thickness (t) of the expandable metal member. Element 7: wherein the plurality of dissimilar cathodic electric conductor wires are inconsistently positioned within the sidewall thickness (t) of the expandable metal member. Element 8: wherein the plurality of dissimilar cathodic electric conductor wires include exposed portions at one or more sidewalls of the expandable metal member, and further including one or more end rings coupled with the one or more sidewalls to isolate the exposed portions of the plurality of dissimilar cathodic electric conductor wires. Element 9: further including an insulating material located between the exposed portions and the one or more end rings. Element 10: wherein the second rate is at least 125 percent of the first rate. Element 11: wherein the second rate is at least 150 percent of the first rate. Element 12: wherein the second rate is at least 200 percent of the first rate. Element 13: wherein the second rate is at least 300 percent of the first rate. Element 14: wherein the second rate is at least 500 percent of the first rate.

Those skilled in the art to which this application relates will appreciate that other and further additions, deletions, substitutions and modifications may be made to the described embodiments.

What is claimed is:

1. A downhole tool, comprising:

a structure;

an anodic expandable metal member positioned about the structure, the anodic expandable metal member comprising a metal configured to expand in response to hydrolysis and having a first electrode potential value; and a dissimilar cathodic electric conductor isolated within and in electrical contact with the anodic expandable metal member, the dissimilar cathodic electric conductor comprising a dissimilar metal having a second electrode potential value greater than the first electrode potential value, the first electrode potential value and the second electrode potential value configured to initiate a galvanic corrosion effect to increase an expansion rate of the anodic expandable metal member when a reactive fluid comes into contact with the dissimilar cathodic electric conductor and the anodic expandable metal member.

2. The downhole tool as recited in claim 1, wherein the dissimilar cathodic electric conductor is a plurality of dissimilar cathodic electric conductor wires located within a sidewall thickness (t) of the anodic expandable metal member.

3. The downhole tool as recited in claim 2, wherein the plurality of dissimilar cathodic electric conductor wires have a length (l) and a longest cross-sectional dimension (d), and further wherein the length (l) is at least 3 times greater than the longest cross-sectional dimension (d).

4. The downhole tool as recited in claim 2, wherein the plurality of dissimilar cathodic electric conductor wires are a first plurality of dissimilar cathodic electric conductor wires positioned at a first inner radial distance within the sidewall thickness (t) of the anodic expandable metal member, and further including a second plurality of dissimilar cathodic electric conductor wires positioned at a second outer radial distance within the sidewall thickness (t) of the anodic expandable metal member.

5. The downhole tool as recited in claim 4, wherein the first plurality of dissimilar cathodic electric conductor wires are spaced equidistance with the sidewall thickness (t) of the anodic expandable metal member at the first inner radial distance, and the second plurality of dissimilar cathodic electric conductor wires are spaced equidistance with the sidewall thickness (t) of the anodic expandable metal member at the second outer radial distance.

6. The downhole tool as recited in claim 4, wherein the first plurality of dissimilar cathodic electric conductor wires and the second plurality of dissimilar cathodic electric conductor wires have different cross-sectional areas.

7. The downhole tool as recited in claim 2, wherein the plurality of dissimilar cathodic electric conductor wires are positioned at a radial distance about and spaced equidistance within the sidewall thickness (t) of the anodic expandable metal member.

8. The downhole tool as recited in claim 2, wherein the plurality of dissimilar cathodic electric conductor wires are inconsistently positioned within the sidewall thickness (t) of the anodic expandable metal member.

9. The downhole tool as recited in claim 2, wherein the plurality of dissimilar cathodic electric conductor wires include exposed portions at one or more sidewalls of the anodic expandable metal member, and further including one or more end rings coupled with the one or more sidewalls to isolate the exposed portions of the plurality of dissimilar cathodic electric conductor wires.

10. The downhole tool as recited in claim 9, further including an insulating material located between the exposed portions and the one or more end rings.

11. A well system, comprising:

a wellbore positioned within a subterranean formation;

a downhole tool positioned within the wellbore, the downhole tool including:

a structure;

an anodic expandable metal member positioned about the structure, the anodic expandable metal member comprising a metal configured to expand in response to hydrolysis and having a first electrode potential value; and a dissimilar cathodic electric conductor isolated within and in electrical contact with the anodic expandable metal member, the dissimilar cathodic electric conductor comprising a dissimilar metal having a second electrode potential value greater than the first electrode potential value, the first electrode potential value and the second electrode potential value configured to initiate a galvanic corrosion effect to increase an expansion rate of the anodic expandable metal member when a reactive fluid comes into contact with the dissimilar cathodic electric conductor and the anodic expandable metal member.

12. The well system as recited in claim 11, wherein the dissimilar cathodic electric conductor is a plurality of dissimilar cathodic electric conductor wires located within a sidewall thickness (t) of the anodic expandable metal member.

13. The well system as recited in claim 12, wherein the plurality of dissimilar cathodic electric conductor wires have a length (l) and a longest cross-sectional dimension (d), and further wherein the length (l) is at least 3 times greater than the longest cross-sectional dimension (d).

14. The well system as recited in claim 12, wherein the plurality of dissimilar cathodic electric conductor wires are a first plurality of dissimilar cathodic electric conductor wires positioned at a first inner radial distance within the sidewall thickness (t) of the anodic expandable metal member, and further including a second plurality of dissimilar cathodic electric conductor wires positioned at a second outer radial distance within the sidewall thickness (t) of the anodic expandable metal member.

15. The well system as recited in claim 14, wherein the first plurality of dissimilar cathodic electric conductor wires are spaced equidistance with the sidewall thickness (t) of the anodic expandable metal member at the first inner radial distance, and the second plurality of dissimilar cathodic electric conductor wires are spaced equidistance with the sidewall thickness (t) of the anodic expandable metal member at the second outer radial distance.

16. The well system as recited in claim 14, wherein the first plurality of dissimilar cathodic electric conductor wires and the second plurality of dissimilar cathodic electric conductor wires have different cross-sectional areas.

17. The well system as recited in claim 12, wherein the plurality of dissimilar cathodic electric conductor wires are positioned at a radial distance about and spaced equidistance within the sidewall thickness (t) of the anodic expandable metal member.

18. The well system as recited in claim 12, wherein the plurality of dissimilar cathodic electric conductor wires are inconsistently positioned within the sidewall thickness (t) of the anodic expandable metal member.

19. The well system as recited in claim 12, wherein the plurality of dissimilar cathodic electric conductor wires include exposed portions at one or more sidewalls of the anodic expandable metal member, and further including one or more end rings coupled with the one or more sidewalls to isolate the exposed portions of the plurality of dissimilar cathodic electric conductor wires.

20. The well system as recited in claim 19, further including an insulating material located between the exposed portions and the one or more end rings.

21. A method, comprising:

positioning a downhole tool within a wellbore of a subterranean formation, the downhole tool including:

a structure;

an anodic expandable metal member positioned about the structure, the anodic expandable metal member comprising a metal configured to expand in response to hydrolysis and having a first electrode potential value; and a dissimilar cathodic electric conductor isolated within and in electrical contact with the anodic expandable metal member, the dissimilar cathodic electric conductor comprising a dissimilar metal having a second electrode potential value greater than the first electrode potential value;

subjecting the anodic expandable metal member to a reactive fluid, the reactive fluid:

causing the anodic expandable metal member to expand at a first expansion rate while the dissimilar cathodic electric conductor is isolated from the reactive fluid; and initiating a galvanic corrosion effect between the anodic expandable metal member and the dissimilar cathodic electric conductor when the reactive fluid comes into contact with the dissimilar cathodic electric conductor and the anodic expandable metal member, the galvanic corrosion effect causing the expansion of the expandable metal member to increase from the first expansion rate to a second greater expansion rate.

22. The method as recited in claim 21, wherein the second expansion rate is at least 125 percent of the first expansion rate.

23. The method as recited in claim 21, wherein the second expansion rate is at least 150 percent of the first expansion rate.

24. The method as recited in claim 21, wherein the second expansion rate is at least 200 percent of the first expansion rate.

25. The method as recited in claim 21, wherein the second expansion rate is at least 300 percent of the first expansion rate.

26. The method as recited in claim 21, wherein the second expansion rate is at least 500 percent of the first expansion rate.

* * * * *